US007078140B2

(12) United States Patent
Yoshimura et al.

(10) Patent No.: US 7,078,140 B2
(45) Date of Patent: Jul. 18, 2006

(54) ELECTROPHOTOGRAPHIC PHOTOSENSITIVE MEMBER, ELECTROPHOTOGRAPHIC APPARATUS, AND PROCESS CARTRIDGE

(75) Inventors: Kimihiro Yoshimura, Kanagawa (JP); Yosuke Morikawa, Kanagawa (JP); Tatsuya Ikezue, Kanagawa (JP); Kouichi Nakata, Shizuoka (JP); Shuji Ishii, Chiba (JP); Daisuke Tanaka, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 369 days.

(21) Appl. No.: 10/618,628

(22) Filed: Jul. 15, 2003

(65) Prior Publication Data

US 2004/0063014 A1 Apr. 1, 2004

(30) Foreign Application Priority Data

Jul. 15, 2002 (JP) ..... 2002-205793

(51) Int. Cl.
*G03G 5/047* (2006.01)

(52) U.S. Cl. ..... 430/59.6; 430/66; 430/67; 399/159

(58) Field of Classification Search ..... 430/59.6, 430/66, 67; 399/116, 159
See application file for complete search history.

(56) References Cited

U.S. PATENT DOCUMENTS

| | | | | |
|---|---|---|---|---|
| 5,357,320 | A | 10/1994 | Kashimura et al. | 355/211 |
| 5,485,250 | A | 1/1996 | Kashimura et al. | 355/211 |
| 5,800,955 | A | 9/1998 | Kashimura et al. | 430/58 |
| 5,994,011 | A * | 11/1999 | Kashimura | 430/58.1 |
| 6,405,005 | B1 * | 6/2002 | Kitamura et al. | 399/159 |

OTHER PUBLICATIONS

Abstract EP 0 969329A1, published Jan. 5, 2000.
Abstract JP 6-308756, published Nov. 4, 1994.
Abstract JP 3-123360, published May 27, 1991.

* cited by examiner

*Primary Examiner*—John L Goodrow
(74) *Attorney, Agent, or Firm*—Fitzpatrick, Cella, Harper & Scinto

(57) ABSTRACT

According to the present invention, there is provided: an electrophotographic photosensitive member having a photosensitive layer on a support in which a surface layer of the electrophotographic photosensitive member comprises an acrylic polymer having a polyfluoroolefin unit and an alkylene oxide unit, and having a number-average molecular weight in a range of 2,000 to 20,000; a process cartridge and an electrophotographic apparatus both comprising the electrophotographic photosensitive member.

19 Claims, 3 Drawing Sheets

ELECTROPHOTOGRAPHIC PHOTOSENSITIVE MEMBER, ELECTROPHOTOGRAPHIC APPARATUS, AND PROCESS CARTRIDGE

BACKGROUND OF THE INVENTION

1. Field of the Invention

The present invention relates to an electrophotographic photosensitive member, a process cartridge having an electrophotographic photosensitive member, and an electrophotographic apparatus.

2. Description of the Related Art

An electrophotographic photosensitive member is required to have sensitivity, electrical characteristics, and optical characteristics in accordance with an electrophotographic process to be applied. In particular, an electrical or mechanical external force, caused by charging, development with toner, transfer to paper, cleaning, and the like, is directly applied to the surface of an electrophotographic photosensitive member to be repeatedly used; therefore, the electrophotographic photosensitive member is required to have durability with respect to them.

More specifically, the electrophotographic photosensitive member is required to have durability with respect to the abrasion, scratches or generation of abnormal sounds on the surface of the electrophotographic photosensitive member, caused by the friction with a charging member, a cleaning member, a transfer member, and other auxiliary members, and the degradation of the surface caused by ozone and the adhesion of a nitrogen oxide both generated during charging (primary charging) of the electrophotographic photosensitive member under high humidity.

Recently, an electrophotographic apparatus has been commercialized, in which a gap between the contact charging member applied with a D.C. voltage or a D.C. voltage superimposed with an A.C. voltage and the electrophotographic photosensitive member surface is discharged, whereby an electrophotographic photosensitive member is charged. According to such a contact charging system, compared with a conventional corona charging system, oxidizing gas such as ozone and nitrogen oxide is less generated. However, binding of molecular chains of molecules constituting the surface of an electrophotographic photosensitive member is cut by high discharge energy. Therefore, there arises a problem in that the surface is degraded more.

Furthermore, there is also a problem in that toner adheres to the surface of an electrophotographic photosensitive member caused by repetition of development and cleaning. Regarding this problem, there is a demand that a cleaning property of the surface of the electrophotographic photosensitive member is enhanced.

As means for solving the above-mentioned problems, JP 05-053358 A discloses that a surface layer using a curable (cross-linking) resin as a binder resin is provided. However, with such a configuration, although the mechanical strength of the surface of an electrophotographic photosensitive member is enhanced, the problem caused by the adhesion of a so-called charging product formed from ozone and nitrogen oxide generated during charging tends to become serious. Accordingly, there is a tendency that a phenomenon occurs, such as image blurring under high humidity, a decrease in a transfer efficiency of toner, and an increase in a friction coefficient between the surface of an electrophotographic photosensitive member and a member contacting it.

Furthermore, JP 06-083094 A discloses that resin particles are included in a surface layer using a thermoplastic resin as a binder resin. However, according to this configuration, although the problem involved in adhesion of a charging product, such as a decrease in transfer efficiency is solved, it is difficult to remarkably improve the mechanical strength of the surface of an electrophotographic photosensitive member. Furthermore, such resin particles may cause light to scatter in a photosensitive layer to decrease an image quality, depending upon the particle size and the dispersion state, and an aggregation of resin particles may become a starting point of scratches of a photosensitive layer.

Furthermore, it is also proposed that silicone oil, stearate, or the like is added to a surface layer to decrease the friction coefficient of the surface of an electrophotographic photosensitive member. The addition of such a compound influences the movement of charge in a photosensitive layer, which causes a change in an image density due to an increase in a remaining potential, image blurring due to a decrease in an electric resistance, and generation of a ghost image due to charge remaining in a photosensitive layer. Furthermore, such silicone oil has a high surface transition, and is localized only in the vicinity of the surface of a photosensitive layer. Therefore, when the surface portion is worn out due to abrasion, the effect of addition of a compound is reduced. Particularly, in the case where a compound such as silicone oil is added to a surface layer, the contactness between the surface layer and a layer below is decreased, which may cause the surface layer to peel off.

Furthermore, in order to suppress the surface transition of a lubricant such as silicone oil, there is a method for dispersing particles having poor solubility among compounds having a small friction coefficient, in a surface layer. Such particles may cause diffusion of an electrostatic latent image due to light scattering and may generate scratching having a staring point of an aggregation, unless the particles are dispersed in a photosensitive layer uniformly. The problem of dispersibility of lubricant particles can be minimized to some degree by adding a dispersant; however, the dispersant may, in turn, prevent the movement of charge in the photosensitive layer and behave like an ion conducting agent under high humidity. Therefore, the dispersant inhibits the characteristics of electrophotography, to decrease a resistance of a surface layer, increase a remaining potential, and generate a ghost image.

Thus, hitherto, it has been difficult to enhance the mechanical strength and electrical strength of the surface of an electrophotographic photosensitive member, to decrease the friction of the surface with various kinds of contact members, and to enhance a transfer efficiency, without causing the problems such as degradation of an image due to light scattering, generation of scratches due to an aggregation, a decrease in resistance of a surface layer, an increase in a remaining potential, generation of a ghost image, and a decrease in contactness of a surface layer.

SUMMARY OF THE INVENTION

Therefore, to solve the problems described above, it is an object of the present invention to provide an electrophotographic photosensitive member having an excellent lubrication property, improved abrasion resistance, and excellent electrophotographic characteristics, without causing a problem such as degradation of an image quality.

Furthermore, it is another object of the present invention to provide a process cartridge and an electrophotographic apparatus having the above-mentioned electrophotographic photosensitive member.

The above-mentioned problems can be solved by including an acrylic polymer containing, a polyfluoroolefin unit and an alkylene oxide unit in a surface layer of an electrophotographic photosensitive member, whereby mechanical strength, electrical strength, and a transfer efficiency can be enhanced, and the friction with respect to various kinds of contact members can be reduced.

That is, the present invention relates to an electrophotographic photosensitive member having a photosensitive layer on a support, characterized in that a surface layer of the electrophotographic photosensitive member comprises an acrylic polymer having a polyfluoroolefin unit and an alkylene oxide unit, and having a number-average molecular weight in a range of 2,000 to 20,000.

Further, the present invention relates to a process cartridge and to an electrophotographic apparatus both of which having the above-mentioned electrophotographic photosensitive member.

These and other advantages of the present invention will become apparent to those skilled in the art upon reading and understanding the following detailed description with reference to the accompanying figures.

DESCRIPTION OF THE PREFERRED EMBODIMENTS

A photosensitive layer of an electrophotographic photosensitive member of the present invention may be a single photosensitive layer in which a charge generating material and a charge transport material are contained in a single layer, or may be a stacked photosensitive layer in which a charge generating layer containing a charge generating material and a charge transport layer containing a charge transport material are stacked. In terms of electrophotographic characteristics, the stacked photosensitive layer is preferable. Furthermore, among the stacked photosensitive layers, a successively stacked photosensitive layer, in which a charge generating layer and a charge transport layer are stacked successively from a support side, is more preferable.

FIGS. 1*a* to 1*d* show examples of a layer configuration of an electrophotographic photosensitive member of the present invention.

Figure 1A:
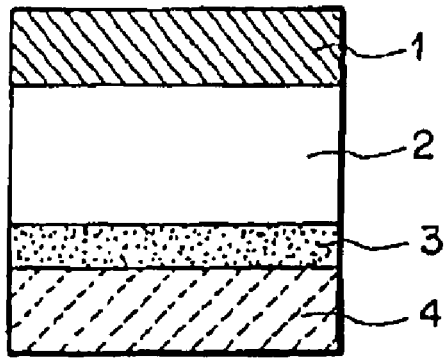
FIGS. 1*a* to 1*d* show examples of a layer configuration of an electrophotographic photosensitive member of the present invention.
Figure 1B:
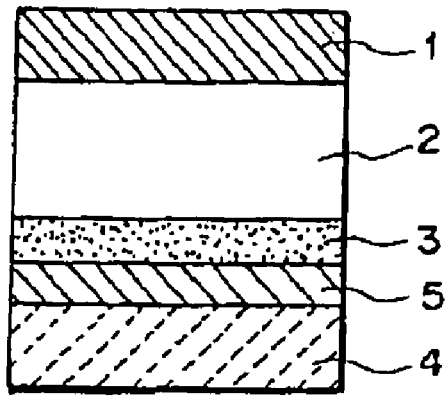
Figure 1C:
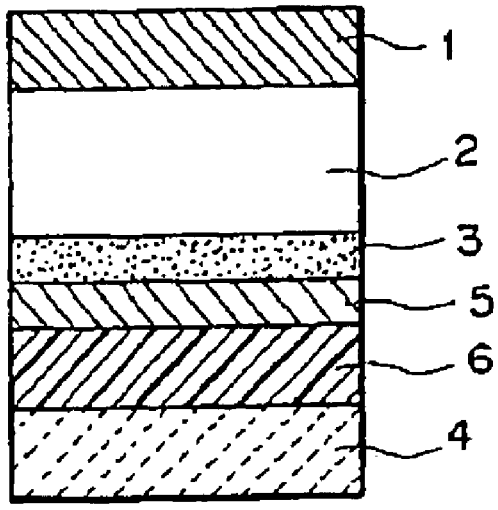

An electrophotographic photosensitive member with a layer configuration shown in FIG. 1*a* has a configuration in which a charge generating layer 3 and a charge transport layer 2 are provided on a support 4 successively, and a layer 1 is formed as a surface layer on the charge transport layer 2. The layer 1 contains an acrylic polymer (hereinafter, referred to as an acrylic polymer of the present invention) with a number-average molecular weight in a range of 2,000 to 20,000, having a polyfluoroolefin unit and an alkylene oxide unit. Furthermore, for example, as shown in FIGS. 1*b* and 1*c*, an intermediate layer (barrier layer, adhesive layer) 5 having a barrier function or an adhesion function, a conductive layer 6 for the purpose of preventing interference fringes, and the like may be provided between the support 4 and the charge generating layer 3.

Figure 1D:
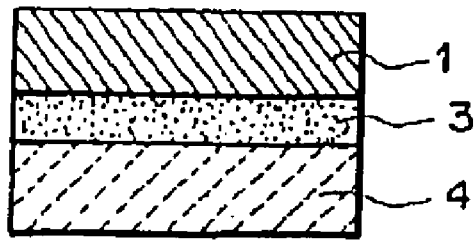

Furthermore, in the electrophotographic photosensitive member with a layer configuration shown in FIG. 1*d*, the charge generating layer 3 is provided on the support 4, and the layer 1 containing an acrylic polymer of the present invention is directly provided, as a surface layer, on the charge generating layer 3.

Any other layer configuration may be used as long as an acrylic polymer of the present invention is contained in a surface layer of an electrophotographic photosensitive member. However, it is preferable that the surface layer containing an acrylic polymer of the present invention is not in contact with the charge generating layer. Furthermore, it is preferable that a charge generating material is not substantially contained in the surface layer containing an acrylic polymer of the present invention. (The phrase "a charge generating material is not substantially contained in the surface layer" means that the charge generating material content of the surface layer is 0 to 5,000 ppm by mass with respect to the total mass of the surface layer). If the surface layer is not in contact with the charge generating layer, or if the charge generating material is not substantially contained in the surface layer, the acrylic polymer of the present invention does not (substantially) come into contact with the charge generating material, and does not influence the injection of charge from the charge generating layer to the charge transport layer (from the charge generating material to the charge transport material).

For the support of the electrophotographic photosensitive member of the present invention, any material that has conductivity may be used. For example, a support made of metal such as aluminum, an aluminum alloy, stainless steel, or the like, can be used. Furthermore, the above-mentioned metal support or a plastic support also may be used, on which aluminum, an aluminum alloy, an indium oxide-tin oxide alloy, or the like is coated by vapor deposition. Furthermore, a support obtained by impregnating conductive particles such as carbon black, tin oxide particles, titanium oxide particles, or silver particles into plastic or paper together with an appropriate binder resin, a plastic support having a conductive binder resin, or the like can be used.

As described above, a conductive layer may be provided on the support for the purpose of preventing interference fringes due to scattering of laser light and of covering scratches on the support. Dispersing conductive particles such as carbon black and metal particles in a binder resin can form the conductive layer. The thickness of the conductive layer is preferably in a range of 5 to 40 μm, more preferably in a range of 10 to 30 μm.

Furthermore, as described above, an intermediate layer having a barrier function or an adhesion function may be provided between the support or the conductive layer and the photosensitive layer (charge generating layer, charge transport layer). The intermediate layer is formed for the purpose of: improving the adhesion of the photosensitive layer, the coating quality and the injection of charge from the support; protecting the photosensitive layer from electrical damage; and the like. The intermediate layer can be formed of a material such as casein, polyvinyl alcohol, ethyl cellulose, an ethylene-acrylic acid copolymer, polyamide, denatured polyamide, polyurethane, gelatin, aluminum oxide, or the like. The thickness of the intermediate layer is preferably 5 μm or less, more preferably 0.1 to 3 μm.

As the charge generating material used in the electrophotographic photosensitive member of the present invention, for example, azo pigments such as monoazo, disazo and trisazo; phthalocyanine pigments such as metal phthalocyanine and non-metal phthalocyanine; indigo pigments such as indigo and thioindigo; perylene pigments such as perylene anhydride and perylene imide; polycyclic quinone pigments such as anthraquinone and pyrenequinone; squarylium dye; pyrylium salt and thiapyrylium salt; triphenylmethane dye; inorganic materials such as selenium, selenium-tellurium and amorphous silicon; quinacridone pigment; azulenium salt pigment; cyanine dye; xanthene dye; quinoneimine dye; styryl dye; cadmium sulfide; and zinc oxide can be given. Of these, in terms of generating efficiency of charge and charge injection properties, azo pigments and phthalocyanine pigments are preferable and metal phthalocyanine pigments are particularly preferable. Further, those charge generating materials may be used separately or two or more types may also be used in combination.

When the photosensitive layer is a laminated photosensitive layer, as the binder resin used in the charge generating layer, for example, polycarbonate resin, polyester resin, polyarylate resin, butyral resin, polystyrene resin, polyvinyl acetal resin, diallyl phthalate resin, acrylic resin, methacrylic resin, vinyl acetate resin, phenol resin, silicone resin, polysulfone resin, styrene-butadiene copolymer resin, alkyd resin, epoxy resin, urea resin, vinyl chloride-vinyl acetate copolymer resin, and the like can be given. One type of those resins may be used singly or two or more types thereof may also be used in combination as a mixture or copolymer.

A solvent used for a coating liquid for a charge generating layer is selected based on the solubility and dispersion stability of a binder resin and a charge generating material to be used. Examples of the organic solvent include alcohol, sulfoxide, ketone, ether, ester, aliphatic halocarbon, an aromatic compound, and the like.

The charge generating layer can be formed by applying a coating liquid for a charge generating layer obtained by dispersing a charge generating material and a binder resin in a solvent, followed by drying. Examples of dispersion methods include those which use a homogenizer, an ultrasonic wave, a ball mill, a sand mill, an attritor, a roll mill, and the like. The ratio between the charge generating material and the binder resin is preferably in a range of 1:0.3 to 1:4.

The coating liquid for a charge generating layer is applied by a coating method such as an immersion coating method, a spray coating method, a spinner coating method, a roller coating method, Meyer bar coating method, and a blade coating method.

Further, the thickness of the charge generating layer is preferably not larger than 5 μm, more preferably in a range of 0.01 to 1 μm.

Furthermore, various sensitizers, an antioxidant, a UV absorbent, a plasticizer, or the like can be added to the charge generating layer, if required.

As the charge transport materials used in the electrophotographic photoreceptor of the present invention, for example, triarylamine compounds, hydrazone compounds, styryl compounds, stilbene compounds, pyrazoline compounds, oxazole compounds, thiazole compounds, triarylmethane compounds, and the like can be given.

For example, as in the case of the charge transport layer 2 of FIGS. 1*a*, 1*b*, and 1*c*, as the binder resin used in the charge transport layer which is not a surface layer of the electrophotographic photoreceptor, for example, acrylic resin, styrene resin, polyester, polycarbonate resin, polyarylate, polysulfone, polyphenylene oxide, epoxy resin, polyurethane resin, alkyd resin, unsaturated resin, and the like can be given. In particular, polymethyl methacrylate, polystyrene, styrene-acrylonitrile copolymer, polycarbonate resin, polyarylate resin, and diallyl phthalate resin are preferable.

The charge transport layer can be formed by applying a coating liquid for a charge transport layer obtained by dissolving a charge transport material and a binder resin in a solvent, followed by drying. The ratio between the charge transport material and the binder resin is preferably in a range of 2:1 to 1:2 (mass ratio).

As the solvent for use in the coating liquid for the charge transport layer, ketones such as acetone and methyl ethyl ketone; esters such as methyl acetate and ethyl acetate; aromatic hydrocarbons such as toluene and xylene; and hydrocarbons substituted with one or more halogen atoms, such as chlorobenzene, chloroform and carbon tetrachloride, can be used.

The coating liquid for a charge transport layer is applied by a coating method, such as an immersion coating method, a spray coating method, a spinner coating method, a roller coating method, Meyer bar coating method, and a blade coating method. When the coating liquid is dried after being applied, the drying temperature is preferably in a range of 10° C. to 200° C., more preferably in a range of 20° C. to 150° C. Furthermore, the drying time is preferably in a range of 5 minutes to 5 hours, more preferably in a range of 10 minutes to 2 hours. The coating liquid may be dried by air blowing or stationary drying.

The thickness of the charge transport layer that is not a surface layer of the electrophotographic photosensitive member is preferably in a range of 5 to 40 μm, more preferably in a range of 7 to 30 μm.

Furthermore, an antioxidant, a UV absorbent, a plasticizer, or the like can be added to the charge transport layer, if required.

As described above, the surface layer of the electrophotographic photosensitive member provided on the photosensitive layer (e.g., on the charge transport layer), or the surface layer of the electrophotographic photosensitive member directly provided on the charge generating layer contains an acrylic polymer of the present invention, i.e., an acrylic polymer having a polyfluoroolefin unit and an alkylene oxide unit, and having a number-average molecular weight of 2,000 to 20,000.

The content of the acrylic polymer of the present invention in the surface layer of the electrophotographic photosensitive member is preferably 0.1 to 20% by mass, more preferably 0.5 to 5% by mass with respect to the total mass of the surface layer.

Furthermore, in the acrylic polymer of the present invention, a molar ratio ($R^F$:$R^O$) of a polyfluoroolefin unit ($R^F$) to an alkylene oxide unit ($R^O$) is preferably 0.1:1 to 2:1, more preferably 0.2:1 to 1:1.

The acrylic polymer of the present invention may be a polymer obtained through the polymerization of an acrylic ester monomer having a polyfluoroolefin unit and/or an alkylene oxide unit with an acrylic alkyl ester having 2 to 12 carbon atoms. In this case, in the acrylic polymer of the present invention, a molar ratio ($R^{FO}/R^{AL}$) of the sum ($R^{FO}$) of the polyfluoroolefin unit and the alkylene oxide unit to the unit ($R^{AL}$) having 2 to 12 carbon atoms is preferably 1:0 to 0.3:0.7, more preferably 0.8:0.2 to 0.5:0.5.

As an exemplary method for including the acrylic polymer of the present invention in a surface layer of the electrophotographic photosensitive member, there is a method for forming a surface layer using a coating liquid for a surface layer containing an acrylic polymer of the present invention and an organic solvent.

As the organic solvent, an organic solvent having a proton acceptor parameter (δa) of 2 or more and having a boiling point of 50° C. to 120° C. is preferable. By using such an organic solvent, the interaction between a layer below the surface layer and the acrylic polymer of the present invention in the surface layer is affected less, and degradation of an image quality such as a ghost does not occur. Furthermore, in the case where resin particles are included in the surface layer, an aggregation thereof can be prevented from being formed. Therefore, scratches caused by an aggregation can be suppressed.

In general, as an index representing the characteristics of a solvent, a solubility parameter (δ) is used. This index is classified into a dispersion solubility parameter, a dipole orientation parameter, a proton acceptor parameter, and a proton donor parameter, depending upon various intermolecular interactions. Among these various kinds of parameters, in order to include the acrylic polymer of the present invention in the surface layer of the electrophotographic photosensitive member by the above method, the proton acceptor parameter (δa) is a particularly important parameter.

Even an organic solvent having solubility with respect to an organic material has a large effect on the portions other than the surface layer, if the organic solvent has a small proton acceptor parameter (δa), which makes it difficult to allow the acrylic polymer of the present invention to exist uniformly in the surface layer.

Table 1 shows preferable examples of organic solvents having a proton acceptor parameter (δa) of 2 or more and having a boiling point of 50° C. to 120° C.

TABLE 1

| Organic solvents | Composition formula | δa | Boiling point [° C.] |
|---|---|---|---|
| Acetone | $C_3H_6O$ | 2.5 | 56.2 |
| Acetonitrile | $C_2H_3N$ | 2.5 | 81.6 |
| 1,4-dioxane | $C_4H_8O_2$ | 3.0 | 101.3 |
| Ethanol | $C_2H_6O$ | 5.0 | 78.3 |
| Ethyl acetate | $C_4H_8O_2$ | 2.0 | 77.1 |
| Methanol | $CH_4O$ | 7.5 | 64.8 |
| Tetrahydrofuran | $C_4H_8O$ | 3.0 | 66.0 |
| 1-propanol | $C_3H_8O$ | 5.0 | 97.5 |

A coating liquid for a surface layer can be applied by a coating method such as an immersion coating method, a spray coating method, a spinner coating method, a roller coating method, Meyer bar coating method, and a blade coating method. In the case of forming the surface layer of the electrophotographic photosensitive member by the immersion coating-method, considering the effect on the layer below the surface layer, a non-aromatic organic solvent is preferable, which has a a proton acceptor parameter (δa) of 2 or more, a boiling point of 50° C. to 120° C., and constitution containing no hetero atoms other then oxygen.

The acrylic polymer of the present invention may be a copolymer obtained from an acrylic ester monomer containing a polyfluoroolefin unit and an acrylic ester monomer containing an alkylene oxide unit, or may be a polymer obtained from an acrylic ester monomer containing both a polyfluoroolefin unit and an alkylene oxide unit.

In the case of obtaining the acrylic polymer of the present invention by the above method, even if resin particles are included in a coating liquid for a surface layer, there is an advantage that the dispersion stability of the resin particles is enhanced, and the coating liquid can be used for a long period of time.

The polyfluoroolefin unit is preferably a polyfluoroalkylene unit.

Further, the above-mentioned alkylene oxide unit is preferably an ethylene oxide unit or a propylene oxide unit and more preferably an ethylene oxide unit. As the alkylene oxide unit is an ethylene oxide unit or a propylene oxide unit, adhesion between the surface layer and the layer therebelow is improved.

Furthermore, the above-mentioned polyfluoroolefin unit preferably has 7 to 29 fluorine atoms per unit, more preferably 9 to 21 fluorine atoms per unit. When the number of fluorine atoms per unit is less than 7, the effect of reducing the friction of the electrophotographic photosensitive member surface may not be easily exhibited. On the other hand, when the number of fluorine atoms per unit is more than 30, it may be difficult to uniformly include the acrylic polymer in the surface layer. In the case where the number of fluorine atoms per one polyfluoroolefin unit is more than 30, the solubility by the organic solvent having the above-mentioned proton acceptor parameter of 2 or more and having a boiling point of 50° C. to 120° C. is decreased. Consequently, the acrylic polymer of the present invention may be unevenly distributed in the surface layer, and its ability to stably disperse resin particles may be decreased.

Furthermore, the alkylene oxide unit preferably has 2 to 4 carbon atoms per unit, more preferably 2 carbon atoms per unit. That is, assuming that the alkylene oxide unit is —O—$R^{11}$— (—$R^{11}$— is an alkylene group), the number of carbon atoms per $R^{11}$ is preferably 2 to 4, more preferably 2. Examples of the alkylene oxide unit include an ethylene oxide unit, a propylene oxide unit, an isopropylene oxide unit, and a butylene oxide unit. When the number of carbon atoms per unit is more than 4, it may be difficult to uniformly include the acrylic polymer in the surface layer. In the case where the number of carbon atoms per unit is more than 4, the solubility by the organic solvent having a proton acceptor parameter of 2 or more and having a boiling point of 50° C. to 120° C. is decreased. Consequently, the acrylic polymer of the present invention may be unevenly distributed in the surface layer, and the adhesion between the surface layer and the layer below may be decreased.

Furthermore, in an acrylic ester monomer having the above-mentioned alkylene oxide unit or in an acrylic ester monomer having both a polyfluoroolefin unit and an alkylene oxide unit, the number of alkylene oxide units is preferably 3 to 20, more preferably, 5 to 10. When the number of alkylene oxide units is less than 3, the effect of the surface layer having an alkylene oxide unit is weakened. Furthermore, the solubility with respect to an organic solvent having a proton acceptor parameter of 2 or more and a boiling point of 50° C. to 120° C. is decreased. Consequently, the acrylic polymer of the present invention may be unevenly distributed in the surface layer, and the adhesion between the surface layer and the layer below may be decreased. On the other hand, when the number of alkylene oxide units is more than 20, the mobility of charge in the surface layer is decreased to cause an increase in a remaining potential, and an increase in a surface resistance of the electrophotographic photosensitive member is enhanced due to the adhesion of a charging product, which may cause image blurring. Furthermore, in the case where the surface layer includes conductive particles, the resistance of the surface layer is likely to be decreased under high humidity, and an image deletion may occur.

Hereinafter, a preferable example of an acrylic ester monomer having a polyfluoroolefin unit will be described.
(PA-1)
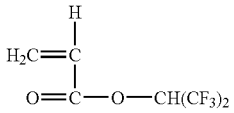
(PA-2)
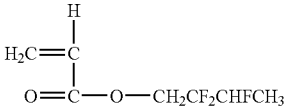
(PA-3)
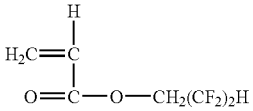
(PA-4)
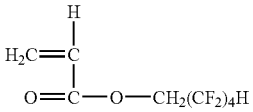
(PA-5)
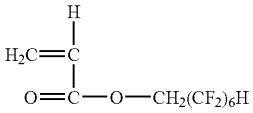
(PA-6)
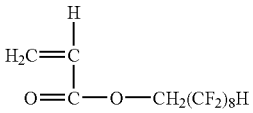
(PA-7)
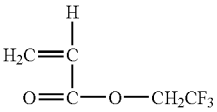
(PA-8)
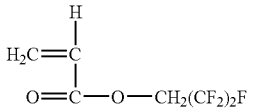
(PA-9)
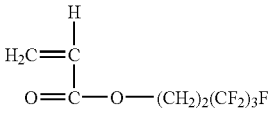
(PA-10)
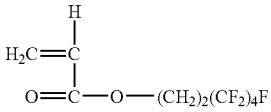
(PA-11)
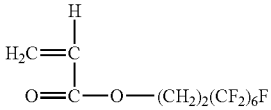
(PA-12)
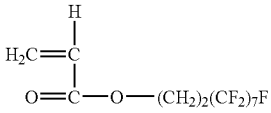
-continued
(PA-13)
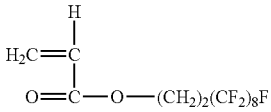
(PA-14)
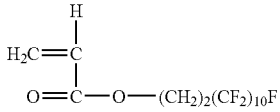
(PA-15)
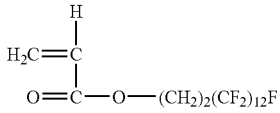
(PA-16)
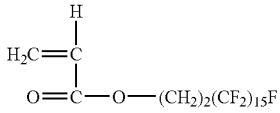
(PA-17)
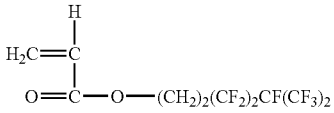
(PA-18)
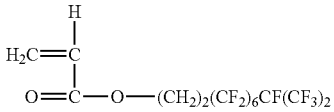
(PA-19)
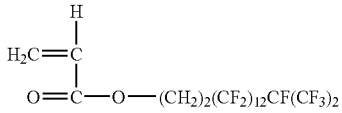
(PA-20)
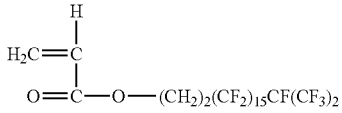
(PA-21)
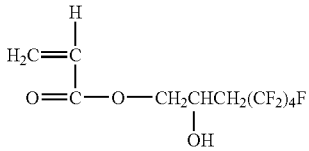
(PA-22)
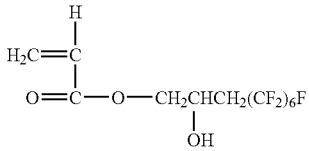
(PA-23)
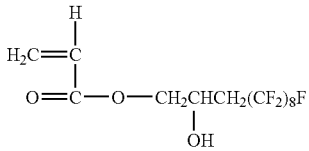

-continued
(PA-24)
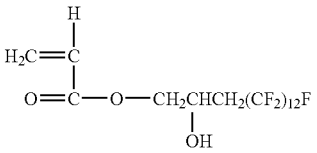
(PA-25)
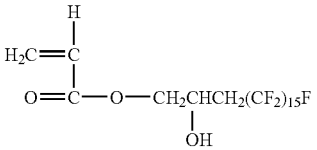
(PA-26)
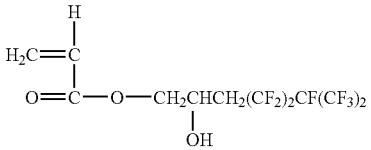
(PA-27)
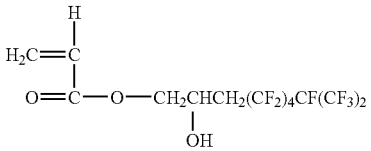
(PA-28)
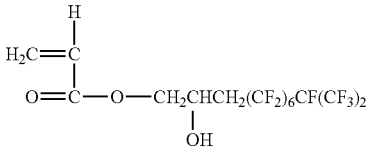
(PA-29)
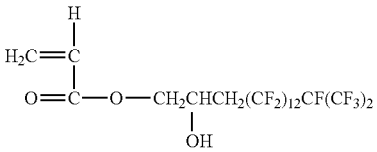
(PA-30)
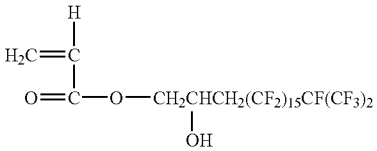
(PA-31)
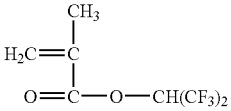
(PA-32)
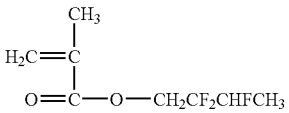
(PA-33)
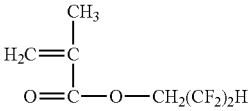
(PA-34)
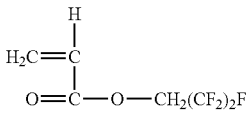
-continued
(PA-35)
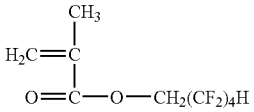
(PA-36)
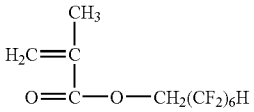
(PA-37)
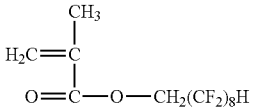
(PA-38)
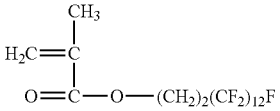
(PA-39)
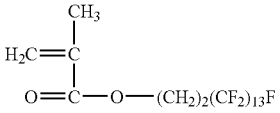
(PA-40)
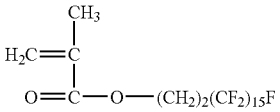
(PA-41)
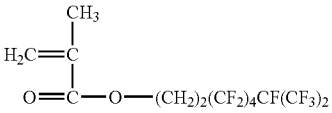
(PA-42)
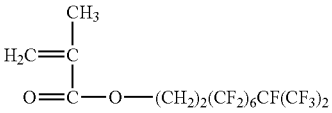
(PA-43)
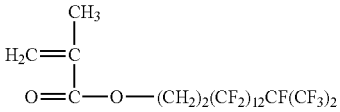
(PA-44)
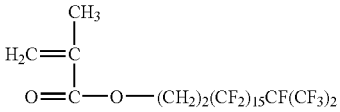
(PA-45)
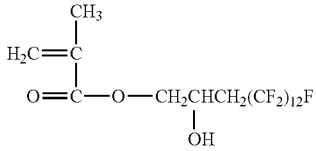
(PA-46)
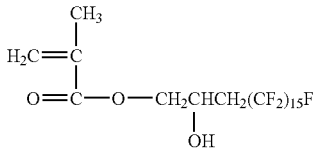

-continued
(PA-47)
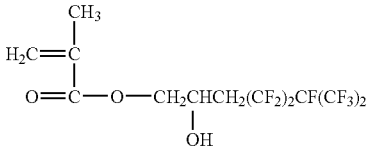
(PA-48)
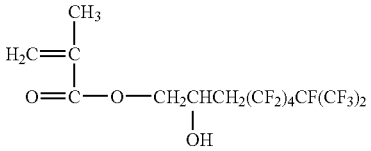
(PA-49)
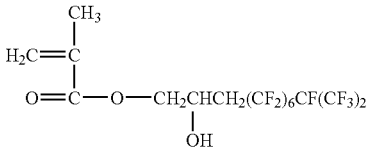
(PA-50)
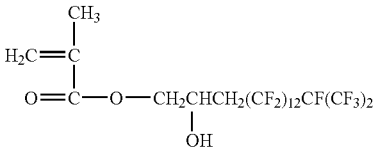
(PA-51)
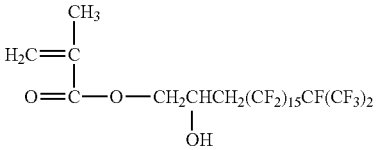
(PA-52)
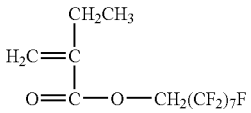
(PA-53)
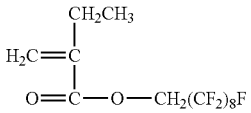
(PA-54)
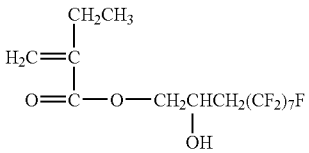
(PA-55)
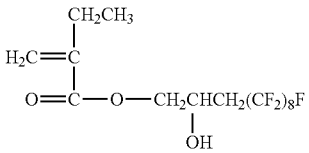
(PA-56)
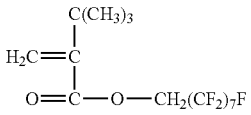
-continued
(PA-57)
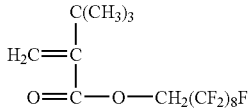
(PA-58)
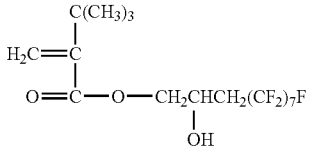
(PA-59)
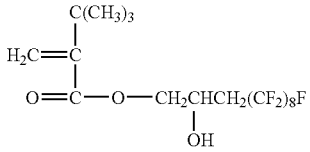
Hereinafter, a preferable example of an acrylic ester monomer having an alkylene oxide unit will be described.
(AA-1)
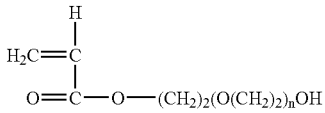
(AA-2)
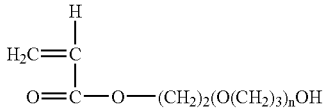
(AA-3)
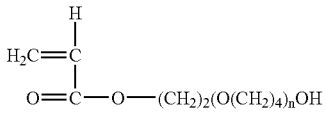
(AA-4)
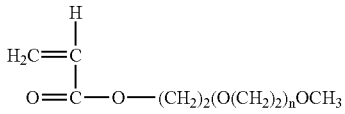
(AA-5)
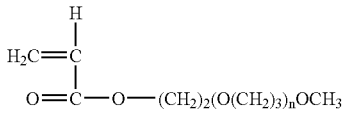
(AA-6)
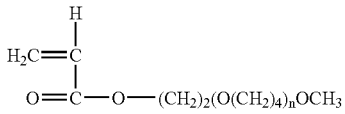
(AA-7)
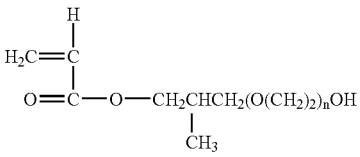

-continued
(AA-8)
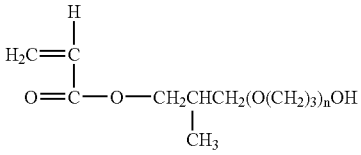
(AA-9)
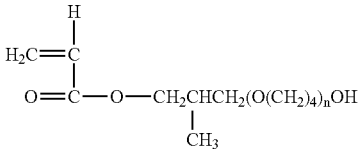
(AA-10)
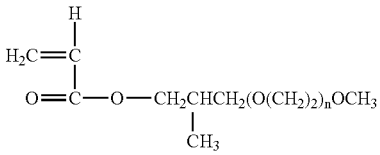
(AA-11)
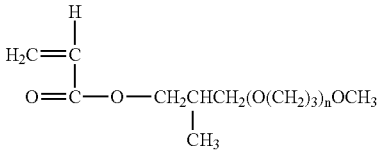
(AA-12)
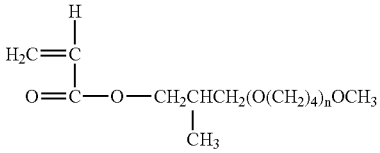
(AA-13)
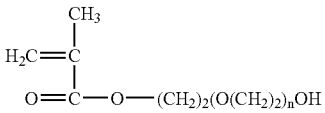
(AA-14)
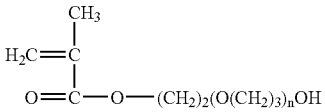
(AA-15)
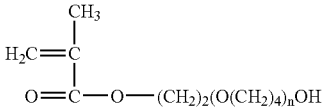
(AA-16)
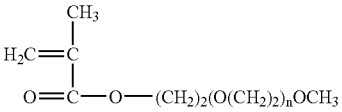
(AA-17)
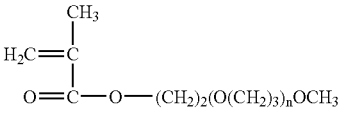
(AA-18)
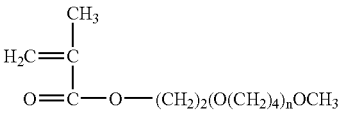
-continued
(AA-19)
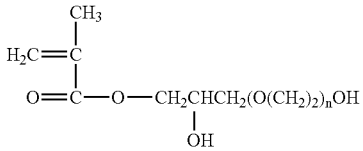
(AA-20)
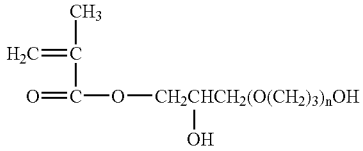
(AA-21)
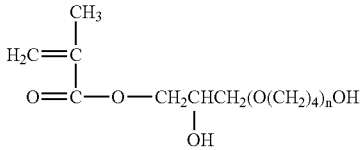
(AA-22)
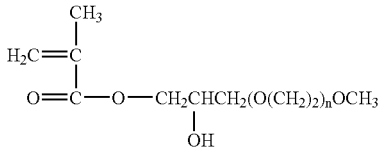
(AA-23)
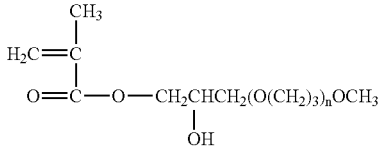
(AA-24)
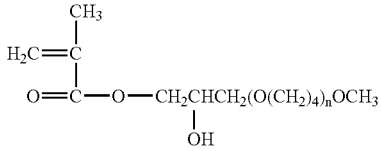
(In the above formulas (AA-1) to (AA-24), n is a positive integer, preferably 3 to 20, more preferably 5 to 10.)
Furthermore, the preferable constitution of an acrylic ester monomer having both a polyfluoroolefin unit and an alkylene oxide unit is represented by the following formula (PAA-A), (PAA-B) or (PAA-C).
(PAA-A)
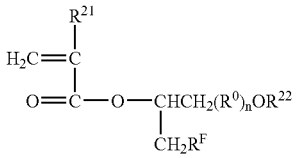
(PAA-B)
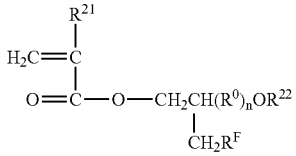

-continued (PAA-C)

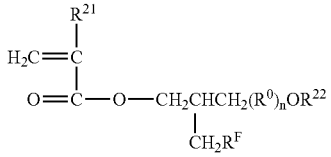

(In the above formulas (PAA-A), (PAA-B), (PAA-C), $R^0$ represents an alkylene oxide unit; $R^F$ represents a polyfluoroolefin unit, and $R^{21}$ and $R^{22}$ each independently represent a hydrogen atom or a methyl group. n represents a positive integer, preferably 3 to 20, more preferably 5 to 10. The number of carbon atoms in $R^0$ is preferably 2 to 4, more preferably 2. The number of fluorine atoms in $R^F$ is preferably 7 to 29, more preferably 9 to 21.)

Hereinafter, a preferable example of the acrylic ester monomer having both a polyfluoroolefin unit and an alkylene oxide unit will be described.

(PAA-1)

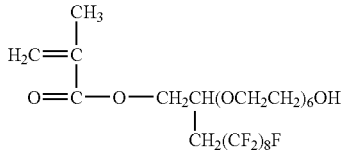

(PAA-2)

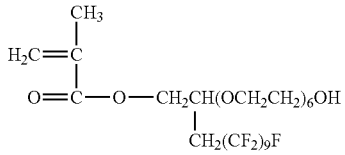

Furthermore, when the acrylic polymer of the present invention is obtained, in addition to the above-mentioned acrylic ester monomer having a polyfluoroolefin unit, the acrylic ester monomer having an alkylene oxide unit, or the acrylic ester monomer having both a polyfluoroolefin unit and an alkylene oxide unit, a third acrylic monomer may be used, for example, in order to enhance the compatibility between the acrylic polymer of the present invention and the binder resin of the surface layer. As the third acrylic monomer, an acrylic alkyl ester is preferable. Among the acrylic alkyl ester, an acrylic alkyl ester having 2 to 12 carbon atoms is more preferable. Furthermore, an alkyl group of the acrylic alkyl ester may have hydroxy group as a substituent. The acrylic polymer of the present invention obtained by using an acrylic alkyl ester having 2 to 12 carbon atoms can more remarkably suppress a decrease in resistance under high humidity. Even in an electrophotographic system in which a lot of adhesion of a charging product is likely to occur, and even in the case where conductive particles are included in the surface layer of the electrophotographic photosensitive member, image blurring does not occur.

Hereinafter, a preferable example of the third acrylic monomer will be described.

(3A-1)

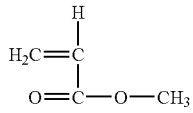

(3A-2)

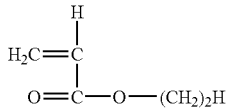

(3A-3)

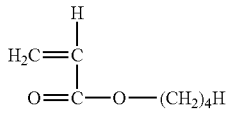

(3A-4)

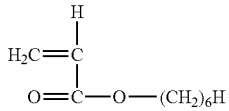

(3A-5)

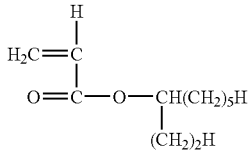

(3A-6)

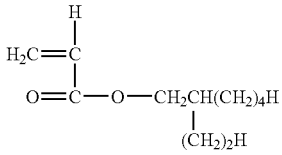

(3A-7)

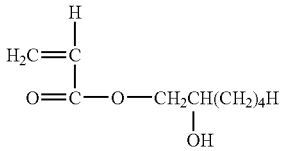

(3A-8)

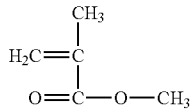

(3A-9)

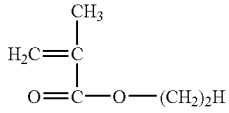

(3A-10)

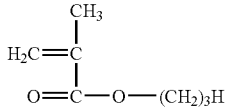

(3A-11)

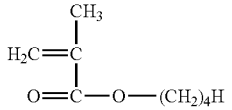

(3A-12)

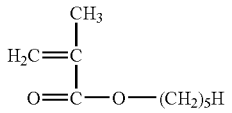

-continued (3A-13)

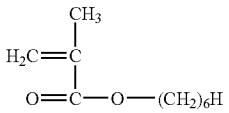

(3A-14)

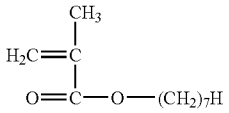

(3A-15)

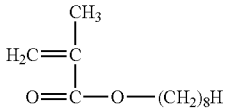

(3A-16)

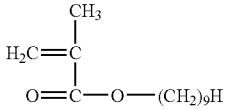

(3A-17)

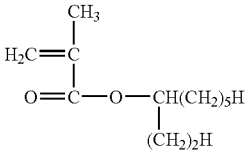

(3A-18)

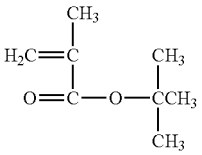

(3A-19)

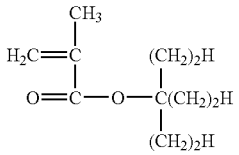

(3A-20)

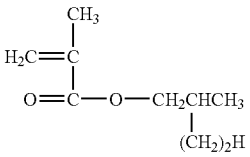

(3A-21)

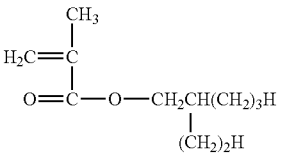

(3A-22)

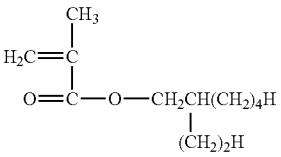

-continued (3A-23)

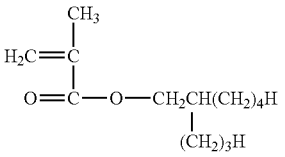

(3A-24)

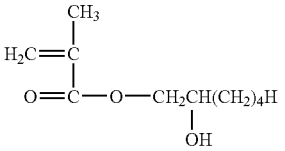

Furthermore, in the surface layer of the electrophotographic photosensitive member of the present invention, thermoplastic resins such as polyalylate resin, polycarbonate resin, polyester resin, polystyrene resin, and polyacrylate resin; and curable resins such as phenol resin, melamine resin, epoxy resin, isocyanate resin, acrylic resin, and siloxane resin can be used as the binder resin. Of those, the curable resins are preferable since they prevent image blurring due to the adhesion of a charging product and generation of abnormal sounds due to the friction between the electrophotographic photosensitive member and the contact member, and remarkably enhance the mechanical strength and the electrical strength of the electrophotographic photosensitive member.

By including the acrylic polymer of the present invention and the curable resin in the surface layer of the electrophotographic photosensitive member, and also by including resin particles therein, problems such as the degradation of an image quality due to light scattering, generation of scratches due to an aggregation, a decrease in resistance of a surface layer, an increase in a remaining potential, generation of a ghost image, and a decrease in adhesion of a surface layer can be prevented. Furthermore, the problem caused by including the resin particles in the surface layer is prevented. Consequently, the mechanical strength and electrical strength of the surface of the electrophotographic photosensitive member can be enhanced, the friction between the surface of the electrophotographic photosensitive member and various kinds of contact members can be decreased, and a transfer efficiency can be enhanced, all of which can be achieved at a higher level.

Furthermore, among the curable resins, those which are obtained from a monomer having a hydroxy group before being cured are more preferable.

Furthermore, according to the present invention, conductive particles and a charge transport material may be included in the surface layer.

As the conductive particles, for example, particles such as zinc oxide, titanium oxide, tin oxide, antimony oxide, indium oxide, bismuth oxide, graphite, carbon black, indium-doped tin oxide, antimony-doped tin oxide, zirconium oxide, and the like may be given. Those conductive particles may be used separately and two or more types thereof may also be used in combination. When using two or more types, they may be in a solid solution state or in a fused state.

The conductive particles content in the surface layer of the electrophotographic photosensitive member is preferably 20 to 80% by mass, more preferably 30 to 60% by mass with respect to the total mass of the surface layer. Furthermore, the conductive particles content is preferably 10 to 500% by mass, more preferably 20 to 50% by mass with respect to the acrylic polymer of the present invention contained in the surface layer.

As previously mentioned, as the charge transport material, triarylamine compounds, hydrazone compounds, styryl compounds, stilbene compounds, pyrazoline compounds, oxazole compounds, thiazole compounds, triarylmethane compounds, and the like can be given. Those charge transport materials may be used separately and two or more types thereof may also be used in combination.

Furthermore, in the case of using a curable resin as a binder resin of the surface layer, and furthermore, in the case of including resin particles in the surface layer, among the above-mentioned charge transport materials, those which have hydroxy group before being cured are preferably used as the charge transport material to be contained in the surface layer.

The charge transport material content in the surface layer of the electrophotographic photosensitive member is preferably 10 to 80% by mass, more preferably 30 to 60% by mass with respect to the total mass of the surface layer. Furthermore, the charge transport material content is preferably 5 to 500% by mass, more preferably 15 to 200% by mass with respect to the acrylic polymer of the present invention contained in the surface layer. Furthermore, the charge transport material content is preferably 4 to 600% by mass, more preferably 10 to 250% by mass with respect to the curable resin contained in the surface layer.

Hereinafter, a preferable example of the charge transport material having hydroxy group will be described.

(C-1)

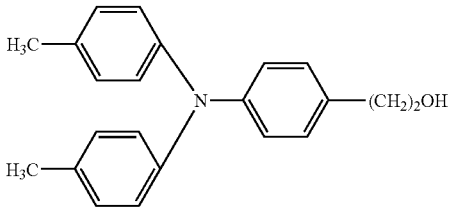

(C-2)

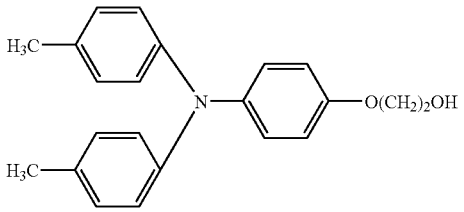

(C-3)

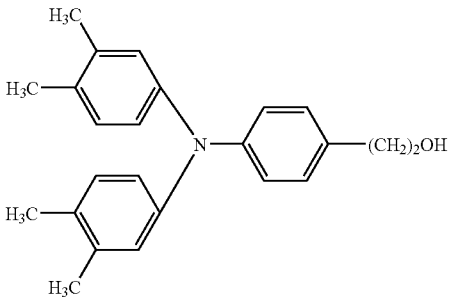

(C-4)

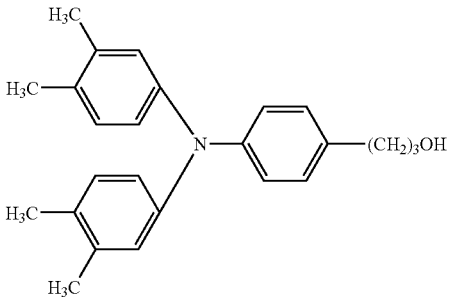

(C-5)

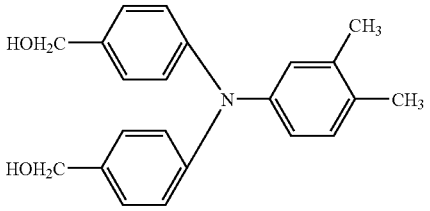

(C-6)

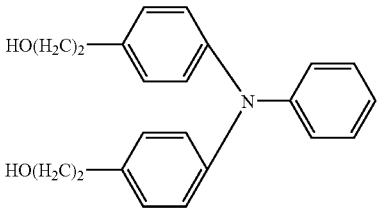

(C-7)

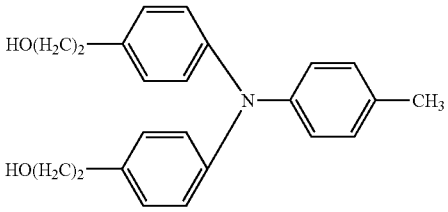

(C-8)

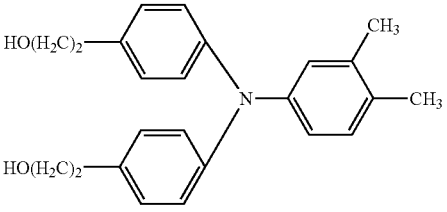

-continued
(C-9)
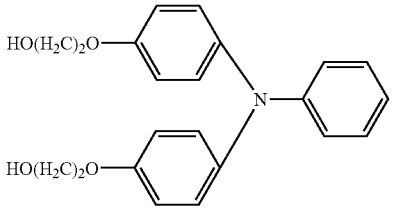
(C-10)
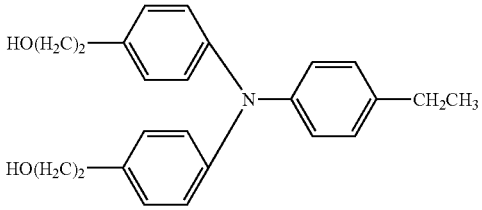
(C-11)
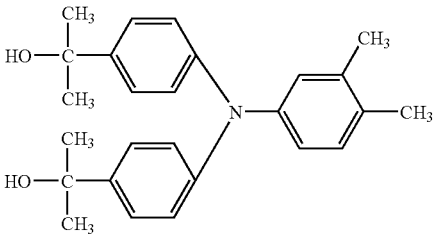
(C-12)
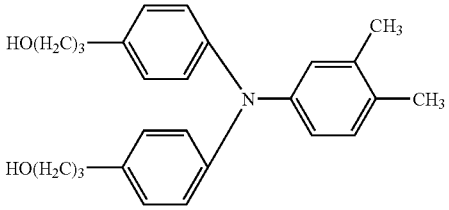
(C-13)
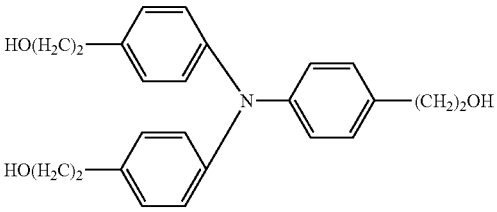
(C-14)
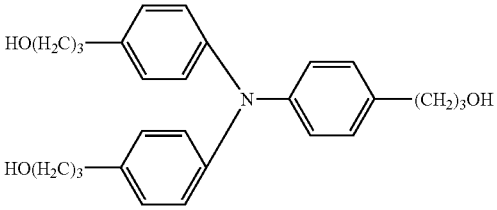
(C-15)
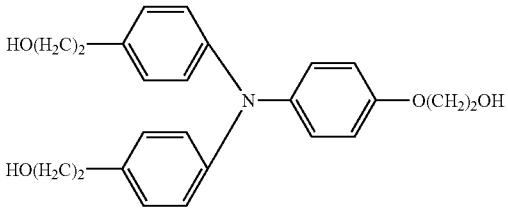
(C-16)
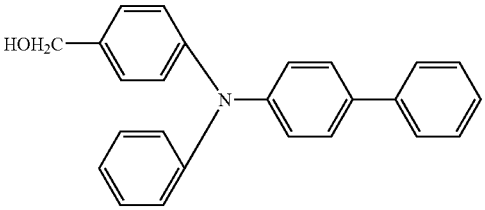
(C-17)
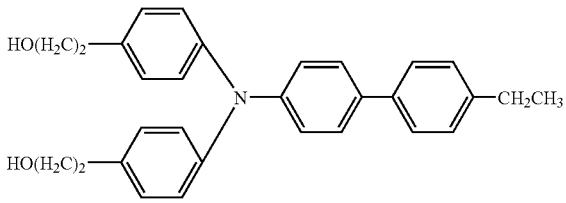
(C-18)
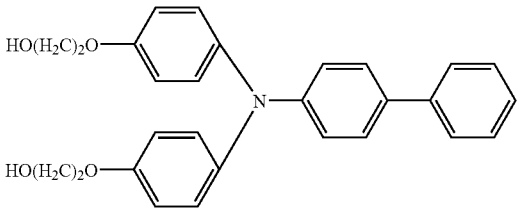
(C-19)
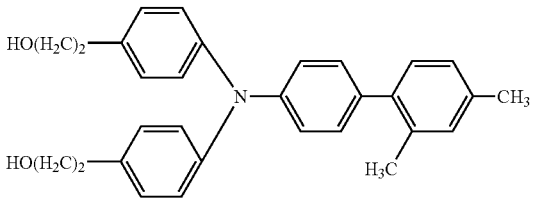

-continued
(C-20)
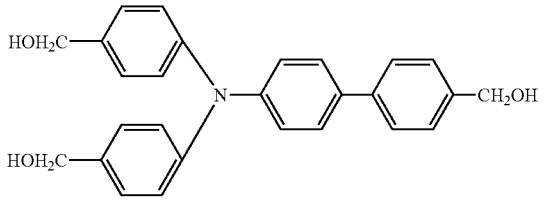
(C-21)
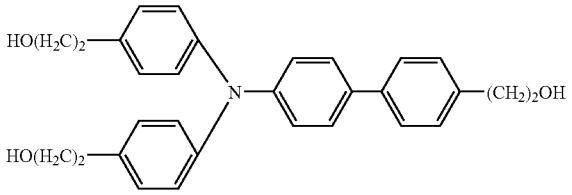
(C-22)
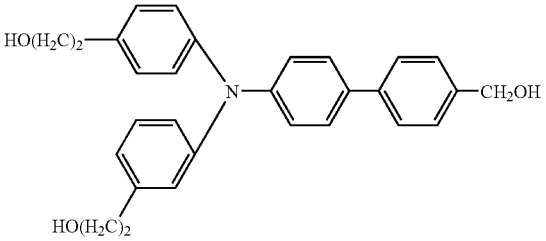
(C-23)
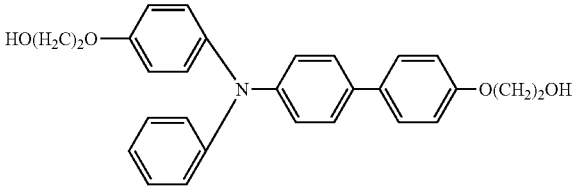
(C-24)
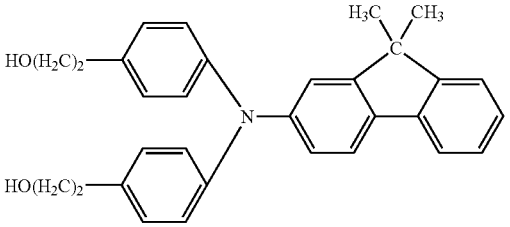
(C-25)
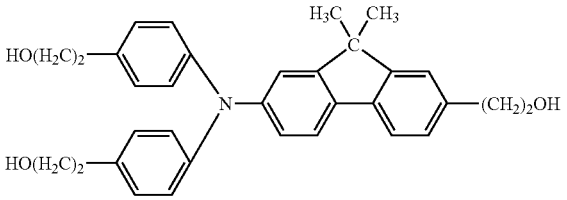
(C-26)
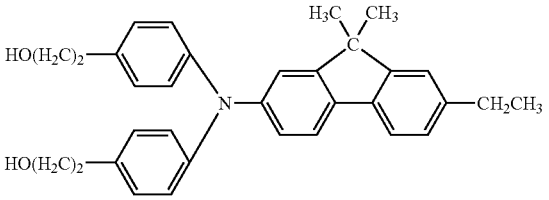
(C-27)
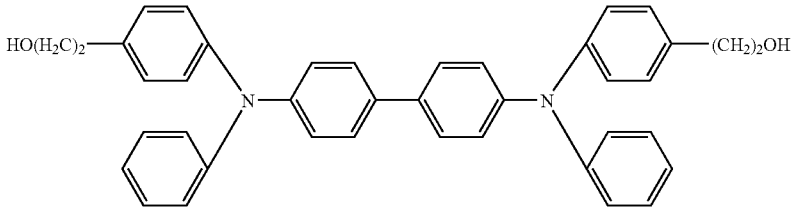
lp;.5p
(C-28)
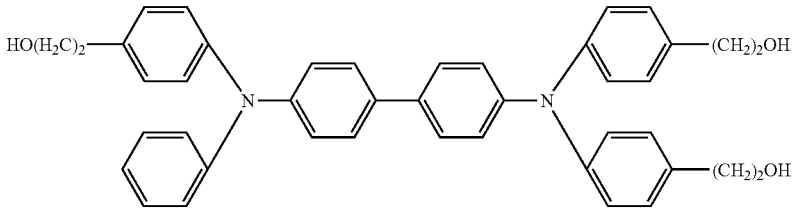

-continued
(C-29)
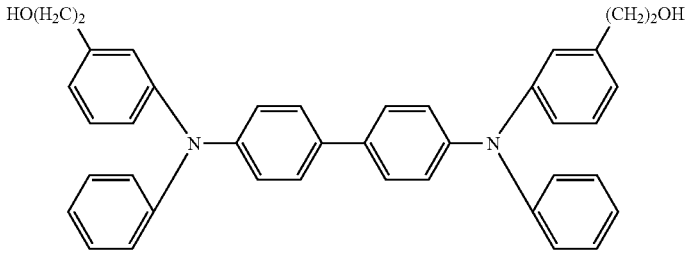
(C-30)
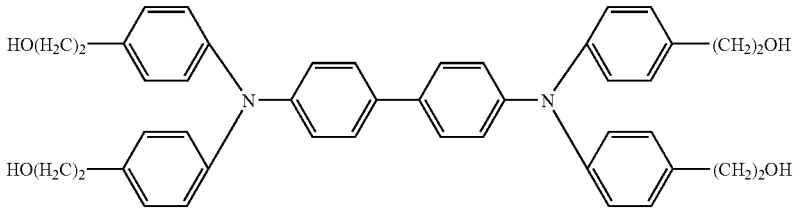
(C-31)
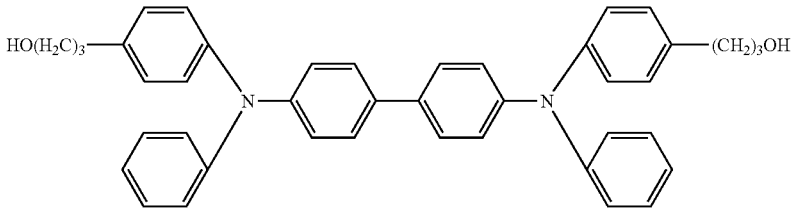
(C-32)
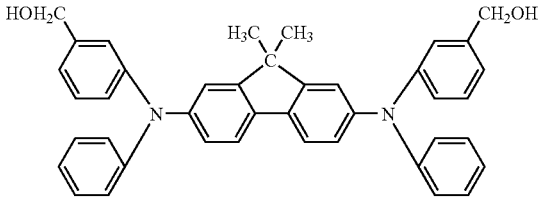
(C-33)
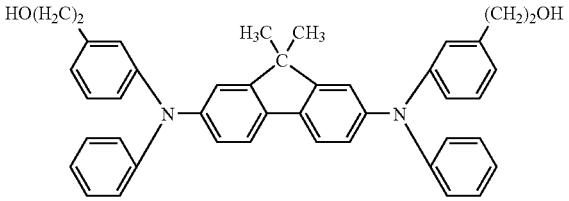
(C-34)
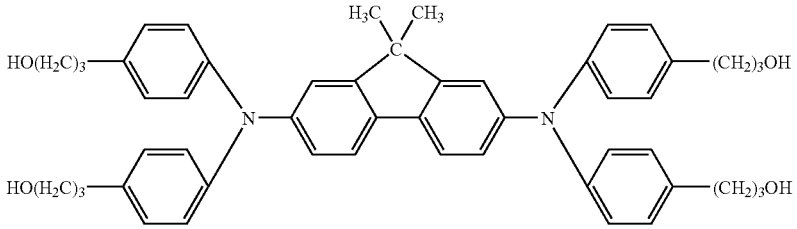

-continued
(C-35)
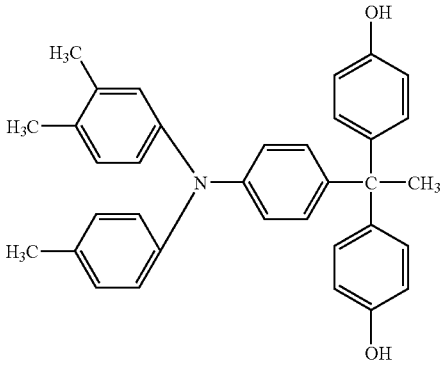
(C-36)
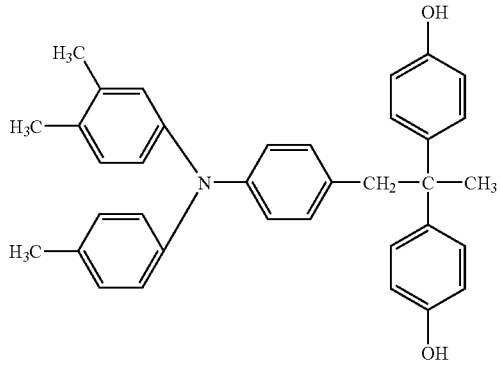
(C-37)
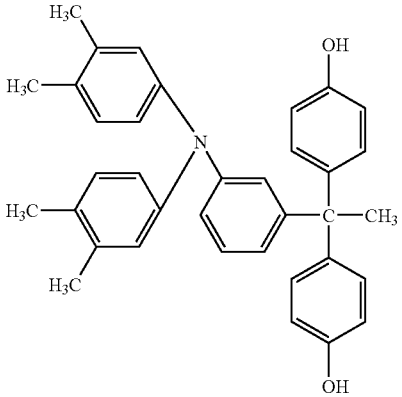
(C-38)
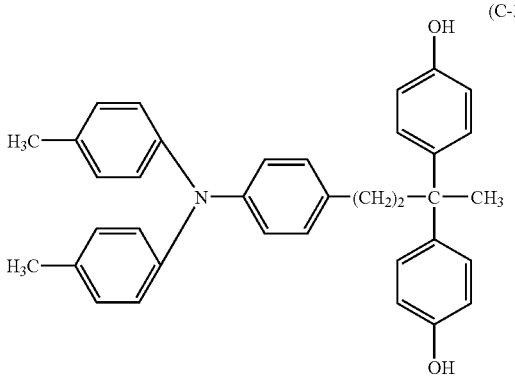
(C-39)
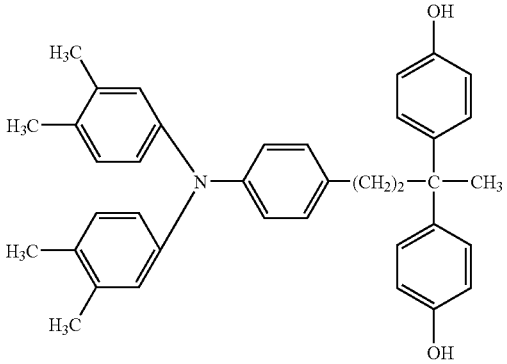
(C-40)
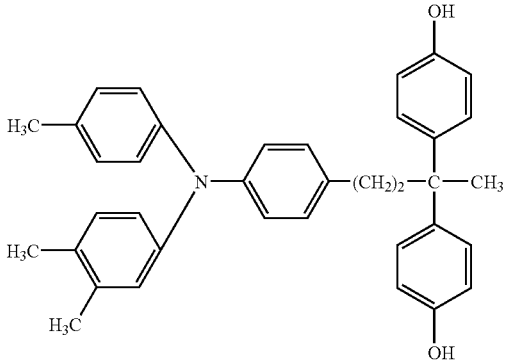
(C-41)
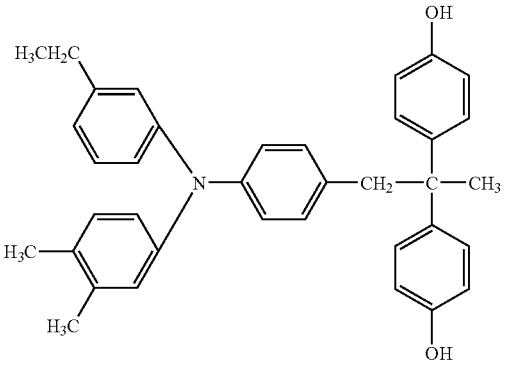
(C-42)
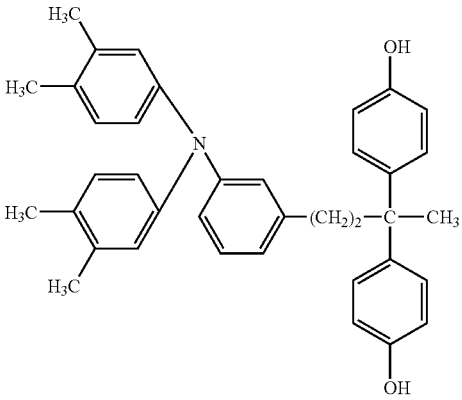

-continued
(C-43)
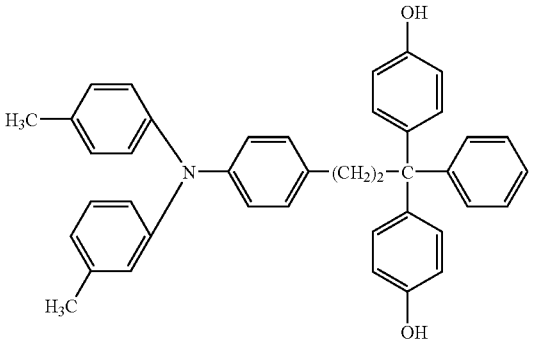
(C-44)
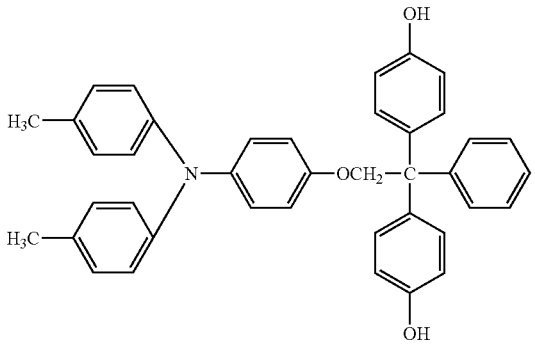
(C-45)
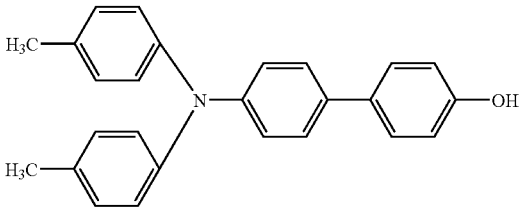
(C-46)
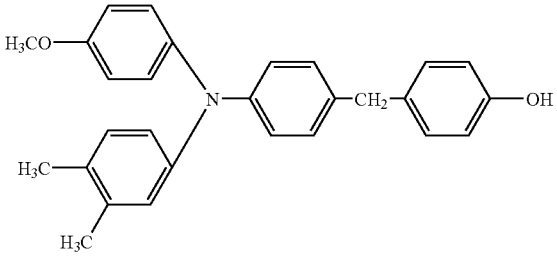
(C-47)
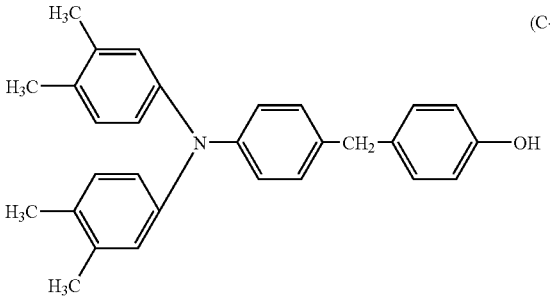
(C-48)
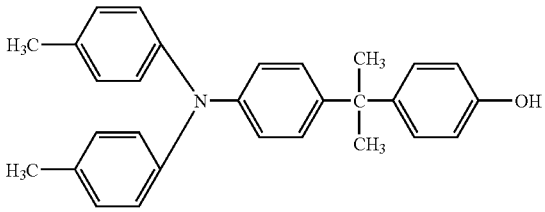
(C-49)
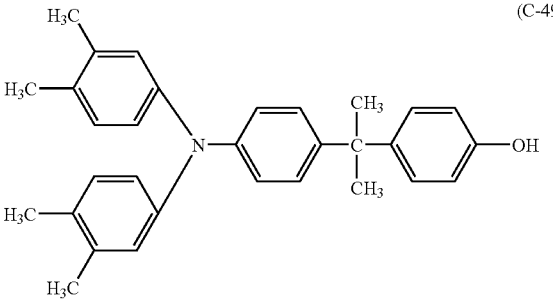
(C-50)
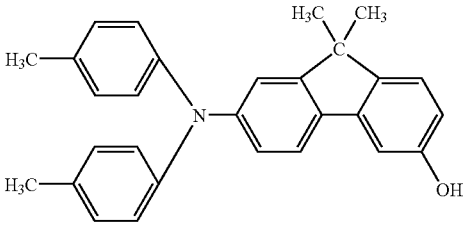
(C-51)
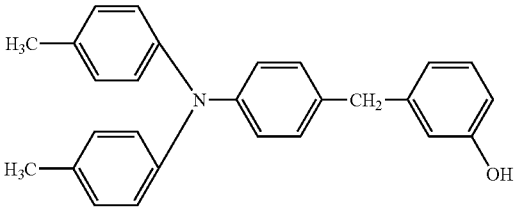
(C-52)
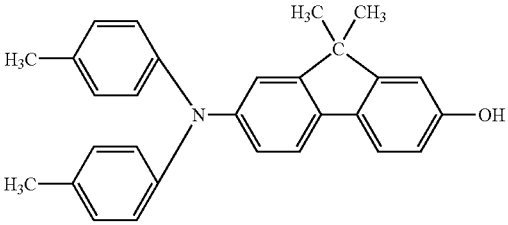

-continued
(C-53)
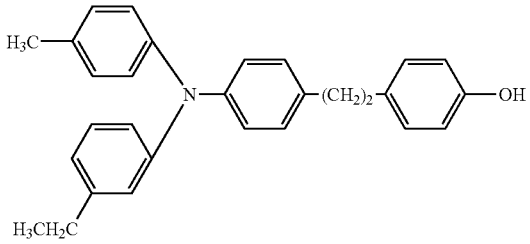
(C-54)
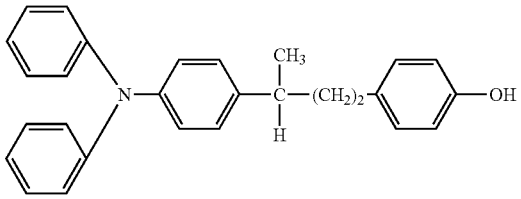
(C-55)
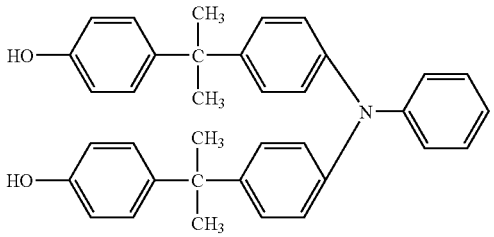
(C-56)
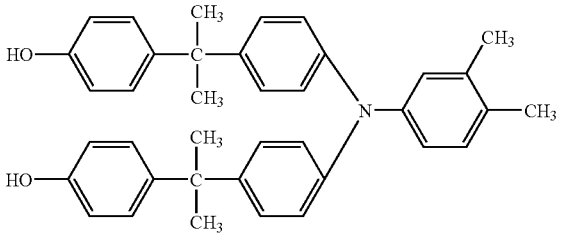
(C-57)
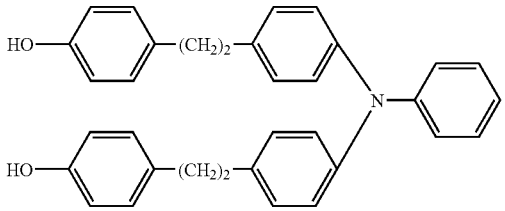
(C-58)
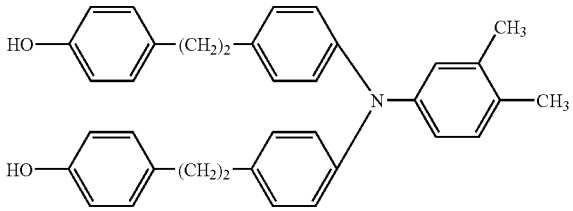
(C-59)
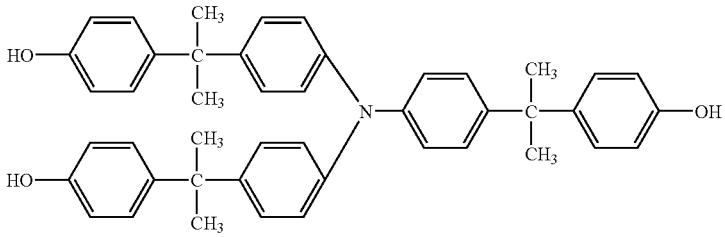
(C-60)
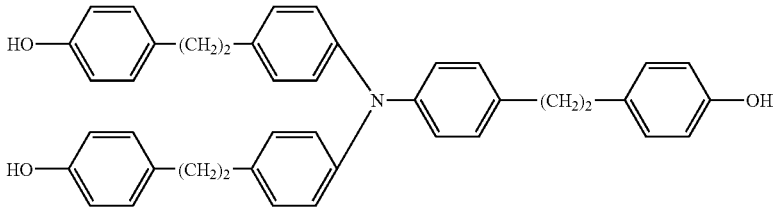
(C-61)
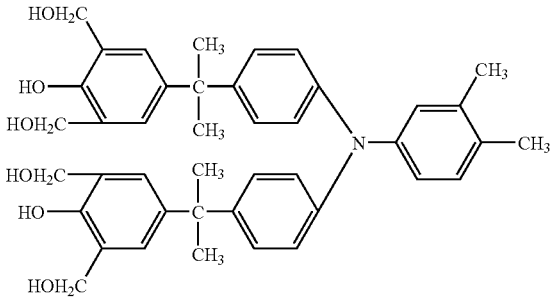

-continued (C-62)

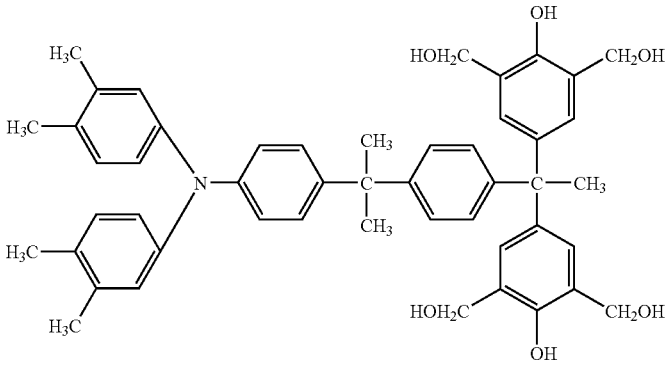

(C-63)

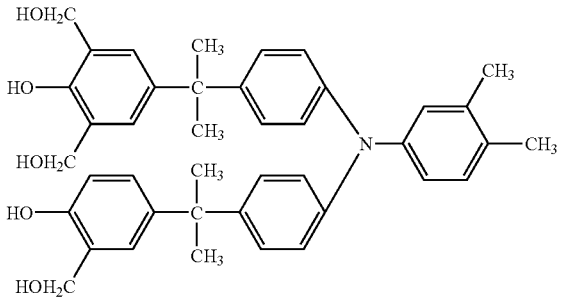

(C-64)

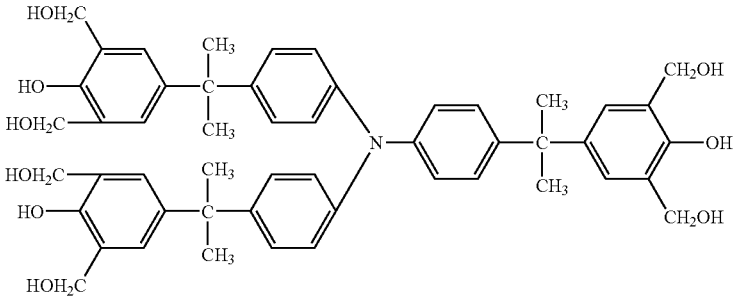

(C-65)

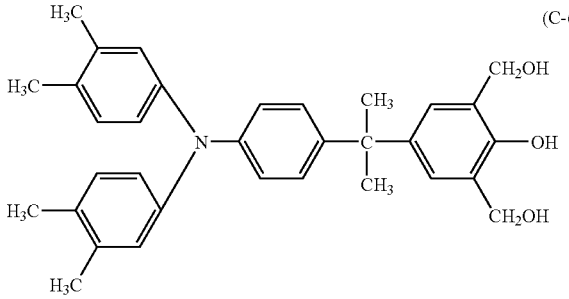

The charge transport materials represented by the compound examples C-62 to C-65 have a hydroxymethyl group at an ortho-position of a phenol hydroxy group. Therefore, heat-curing reaction can be effected only with this compound. In the case of using such a compound as the charge transport material, even if a curable resin is not used as the binder resin, the surface hardness can be maintained to some degree. Furthermore, by using a curable resin as the binder resin, a stronger surface layer can be obtained. Furthermore, even if the binder resin is not used, a curable surface layer having charge transportability and desired surface hardness can be formed by using the curable charge transport material. Furthermore, as described above, the surface layer of the electrophotographic photosensitive member of the present invention may contain resin particles. By including the resin particles in the surface layer of the electrophotographic photosensitive member, the friction coefficient of the surface of the electrophotographic photosensitive member can be decreased. As described above, by using the resin particles, the acrylic polymer of the present invention and the curable resin in the surface layer of the electrophotographic photosensitive member, the problem such as degradation of an image quality due to light scattering can be prevented. As the resin particles, for example, particles of polyethylene, polypropylene, polymethylene oxide, polystyrene, polytetrafluoroethylene, polychlorotrifluoroethylene, polyvinylidene fluoride, polydichlorodifluoroethylene, tetrafluoroethylene-perfluoroalkyl vinyl ether copolymer, tetrafluoroethylene-hexafluoropropylene copolymer, tetrafluoroethylene-ethylene coploymer, tetrafluoroethylene-hexafluoropropylene-perfluoroalkyl vinyl ether copolymer, and the like can be given. Those resin particles may be used separately or two or more types may also be used in combination. Of these resin particles, in terms of further improving transfer efficiency of toner, resin particles containing fluorine atoms and resin particles containing silicon atoms are preferable and, in particular, resin particles containing flourine atoms are more preferable.

The particle size of the resin particles is preferably 0.01 to 10 μm, more preferably 0.05 to 2.0 μm, and most preferably 0.1 to 0.8 μm, since light scattering and formation of an aggregation can be suppressed.

Furthermore, if the polyfluoroolefin unit has 7 to 29 fluorine atoms per unit, the effect of decreasing a friction coefficient of the surface of the electrophotographic photosensitive member can be maintained at a high level, while the particle size of resin particles can be set in the above-mentioned preferable range.

The resin particles content in the surface layer of the electrophotographic photosensitive member is preferably 0.5 to 50% by mass more preferably, 2 to 25% by mass with respect to the total mass of the surface layer. Furthermore, the resin particles content is preferably 1,000 to 5,000% by mass, more preferably 2,000 to 3,000% by mass with respect to the acrylic polymer of the present invention contained in the surface layer. Furthermore, the resin particles content is preferably 1 to 100% by mass, more preferably 3 to 50% by mass with respect to the curable resin contained in the surface layer.

The surface layer of the electrophotographic photosensitive member of the present invention may further contain an antioxidant for the purpose of preventing the degradation of a surface layer due to the adhesion of an active material such as a charging product (ozone, nitrogen oxide, etc.).

Figure 2:
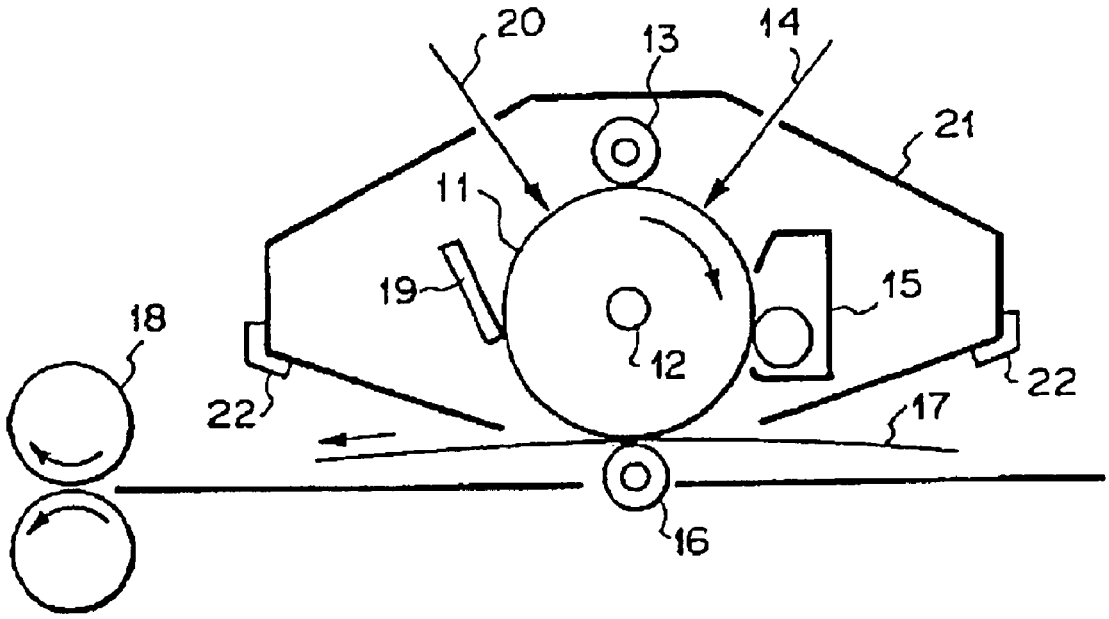
FIG. 2 shows an example of a schematic configuration of an electrophotographic apparatus provided with a process cartridge having an electrophotographic photosensitive member of the present invention.

FIG. 2 shows a schematic configuration of an electrophotographic apparatus provided with a process cartridge having the electrophotographic photosensitive member of the present invention.

In FIG. 2, reference numeral 11 denotes a drum-shaped electrophotographic photosensitive member of the present invention, which is rotated at a predetermined circumferential velocity in an arrow direction with respect to an axis 12. The electrophotographic photosensitive member 11 is charged uniformly with a predetermined positive or negative potential on its circumferential surface by a charging means (primary charging means) 13 during rotation. Then, the electrophotographic photosensitive member 11 is irradiated with exposure light (image exposure light) 14 outputted from an exposure means (not shown), such as a slit exposure unit and a laser beam scanning exposure unit. Thus, an electrostatic latent image corresponding to intended image information is formed successively on the circumferential surface of the electrophotographic photosensitive member 11.

The latent image thus formed is developed with toner by a developing means 15. Then, a toner image formed on the circumferential surface of the electrophotographic photosensitive member 11 is successively transferred by a transfer means 16 to a transfer material 17 such as paper, which is fed from a sheet feeding portion (not shown) and taken to the position between the electrophotographic photosensitive member 11 and the transfer means 16 in synchronization with the rotation of the electrophotographic photosensitive member 11.

The transfer material 17 with a toner image transferred thereon is separated from the circumferential surface of the electrophotographic photosensitive member 11 and is guided to a fixing means 18 to be subjected to image fixation, whereby the transfer material 17 is printed out of an apparatus as an image-formed material (print, copy, etc.).

The circumferential surface of the electrophotographic photosensitive member 11 after transfer of an image has remaining toner removed by a cleaning means 19, whereby the circumferential surface is cleaned. Furthermore, the circumferential surface is diselectrified by preexposure light 20 from the preexposure means (not shown), and thereafter, it is used for image formation again. In the case where the charging means 13 is a contact charging means using a charging roller or the like, the preexposure is not necessarily required.

According to the present invention, the following may be possible: two or more components selected from the electrophotographic photosensitive member 11, the charging means 13, the developing means 15, and the cleaning means 19 are accommodated in a container to be integrated as a process cartridge; the process cartridge is detachably attached to an electrophotographic apparatus main body such as a copier and a laser beam printer. For example, at least one of the charging means 13, the developing means 15, and the cleaning means 19 is integrally supported with the electrophotographic photosensitive member 11 as a process cartridge, which can be used as a process cartridge 21 that is detachably attached to an apparatus main body using a guide means 22 such as a rail of the apparatus main body.

Furthermore, in the case where the electrophotographic apparatus is a copier or a printer, an original is read with reflected light or transmitted light from the original, or with a sensor to be transformed into a signal. The exposure light 14 refers to light radiated by scanning of a laser beam, driving of an LED array, or driving of a liquid crystal shutter array, which are performed based on the above-mentioned signal.

The electrophotographic photosensitive member of the present invention is applicable to not only a copier and a laser beam printer, but also to the field of an electrophotographic application such as a CRT printer, an LED printer, a FAX, a liquid crystal printer, and laser plate-making.

Hereinafter, the present invention will be described in detail by way of specific examples. However, the present invention is not limited thereto. Note that, in the examples, the term "part(s)" refers to "part(s) by mass".

ACRYLIC POLYMER EXAMPLES 1 to 11

Acrylic polymers with a weight-average molecular weight (Mn) shown in Table 2 were obtained from acrylic ester monomers shown in Table 2.

TABLE 2

| Acrylic polymer examples | PPA or | | | PA:AA:3A or PPA:3A or PPA:AA:3A | |
|---|---|---|---|---|---|
| No. | PA | AA | 3A | (Molar ratio) | Mn |
| (1) | PA-13 | AA-13 (n = 5) | 3A-22 | 25:45:30 | 4800 |
| (2) | PA-12 | AA-13 (n = 7) | 3A-21 | 30:45:25 | 16000 |
| (3) | PA-13 | AA-13 (n = 7) | None | 35:65:0 | 7800 |
| (4) | | PPA-1 | None | 100:0 | 7200 |
| (5) | | PPA-2 | 3A-21 | 65:35 | 11000 |
| (6) | PA-13 | AA-14 (n = 4) | 3A-20 | 30:40:30 | 13400 |
| (7) | PA-23 | AA-16 (n = 5) | 3A-20 | 25:30:45 | 9670 |
| (8) | PA-9 | AA-1 (n = 3) | None | 55:45:0 | 1500 |
| (9) | None | AA-4 (n = 7) | None | 0:100:0 | 6340 |
| (10) | PA-39 | None | None | 100:0 | 2200 |
| (11) | | PPA-2<br>AA-14 (n = 4) | 3A-21 | 20:40:40 | 45000 |

In Table 2, PPA refers to an acrylic ester monomer containing a polyfluoroolefin unit and an alkylene oxide unit, PA refers to an acrylic ester monomer containing a polyfluoroolefin unit, AA refers to an acrylic ester monomer containing an alkylene oxide unit and 3A refers to a third acrylic ester monomer.

The weight-average molecular weight (Mn) is a value obtained by measurement of Gel Permeation Column Chromatography (GPC), which is a number-average molecular weight on the basis of polystyrene conversion.

Example 1

An aluminum cylinder (JIS-A3003, aluminum alloy) with a length of 260.5 mm and a diameter of 30 mm used as a support was coated with 5% by mass of methanol solution of polyamide resin (Trade Name: Amilan CM8000, produced by Toray Industries, Inc.) by immersion coating to provide an intermediate layer with a thickness of 0.5 μm.

Then, 3 parts of crystal of hydroxygallium phthalocyanine having the strongest peak at 28.1° of a Bragg angle 2θ±0.2 in CuKα characteristics X-ray diffraction as a charge generating material, and polyvinyl butyral resin (Trade Name: BX-1, produced by Sekisui Chemical Co., Ltd.) as a binder resin were added to 100 parts of cyclohexanone. The mixture was dispersed by a sand mill with glass beads having a diameter of 1 mm for one hour. This dispersion solution was diluted with 100 parts of methyl ethyl ketone to prepare a coating liquid for a charge generating layer. The intermediate layer was coated with the coating liquid by immersion coating, followed by drying at 90° C. for 10 minutes, whereby a charge generating layer with a thickness of 0.15 μm was formed.

Next, 8.5 parts of a charge transport material having a constitution represented by the following formula:

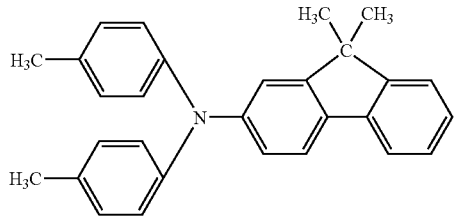

10 parts of a bisphenol Z polycarbonate resin (viscosity-average molecular weight: 20,000, Trade Name: Z-200, produced by Mitsubishi Gas Chemical Co., Inc.) having a repeating unit represented by the following formula:

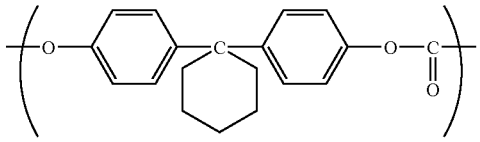

and 1.0 part of the acrylic polymer example (1) were dissolved in 50 parts of monochlorobenzene and 30 parts of tetrahydrofuran. The charge generating layer was coated with this solution by immersion coating, followed by drying with hot air at 110° C. for one hour to form a charge transport layer with a thickness of 17 μm.

Thus, an electrophotographic photosensitive member including a charge transport layer as a surface layer was produced.

Example 2

An electrophotographic photosensitive member was produced in the same way as that in Example 1 except that the bisphenol Z polycarbonate resin in the charge transport layer was changed to polycarbonate resin (viscosity-average molecular weight: 38,000) having a repeating unit represented by the following formula:

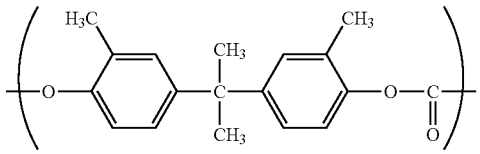

Example 3

An electrophotographic photosensitive member was produced in the same way as that in Example 1 except that the charge generating layer and the charge transport layer (surface layer) were formed as follows.

4 parts of crystal of oxytitanium phthalocyanine having the strongest peak at 9.0°, 14.2°, 23.9°, and 27.1° of a Bragg angle 2θ±0.2 in CuKα characteristics X-ray diffraction as a charge generating material, and 2 parts of a polyvinyl butyral resin (Trade Name: BX-1, produced by Sekisui Chemical Co., Ltd.) as a binder resin were added to 80 parts of cyclohexanone. The mixture was dispersed by a sand mill with glass beads having a diameter of 1 mm for 4 hours to prepare a coating liquid for a charge generating layer. The intermediate layer was coated with the coating liquid by immersion coating, followed by drying at 105° C. for 10 minutes, whereby a charge generating layer with a thickness of 0.22 μm was formed.

Next, 8.5 parts of a charge transport material having a constitution represented by the following formula:

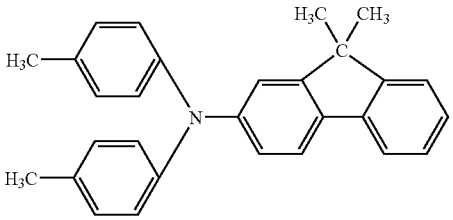

10 parts of polyalylate (viscosity-average molecular weight: 89,000) having a repeating unit represented by the following formula:

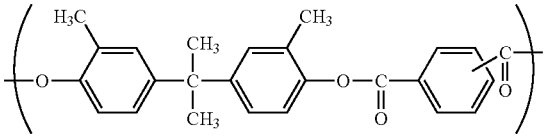

and 1.0 part of the acrylic polymer example (1) were dissolved in 50 parts of monochlorobenzene and 30 parts of tetrahydrofuran. The charge generating layer was coated with this solution by immersion coating, followed by drying with hot air at 110° C. for one hour to form a charge transport layer with a thickness of 17 μm.

Example 4

An electrophotographic photosensitive member was produced in the same way as that in Example 1 except that hydroxygallium phthalocyanine in the charge generating layer was changed to a bisazo pigment having a constitution represented by the following formula:

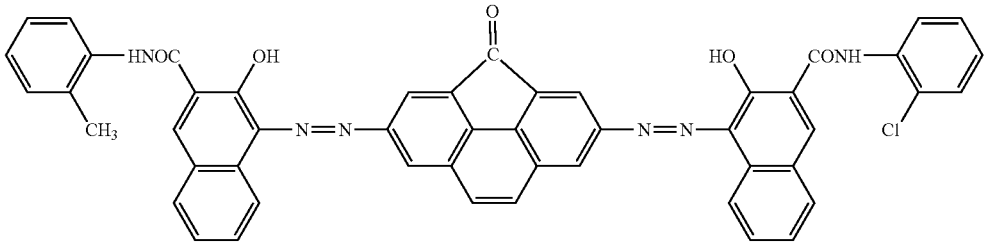

Examples 5–7

Electrophotographic photosensitive members were produced in the same way as that in Example 1 except that the acrylic polymer example (1) in the charge transport layer was changed to acrylic polymer examples (2), (3), and (4), respectively.

Comparative Example 1

An electrophotographic photosensitive member was produced in the same way as that in Example 1 except that an acrylic polymer was not added to the charge transport layer.

Comparative Example 2 and 3

Electrophotographic photosensitive members were produced in the same way as that in Example 1 except that the acrylic polymer example (1) in the charge transport layer was changed to acrylic polymer examples (9) and (10), respectively.

[Evaluation 1]

The electrophotographic photosensitive members produced in Examples 1 to 7 and Comparative Examples 1 to 3 were tested for durable printing of 7,000 sheets of paper in two environments: temperature 5° C./humidity 15 RH % (LL environment) and temperature 32.5° C./humidity 80 RH % (HH environment), using Laser Printer LBP-NX produced by Canon Inc. Laser Printer LBP-NX is provided with a contact charging means adopting a charging roller and a cleaning means adopting a cleaning blade made of urethane rubber. Furthermore, in the contact charging means, a DC voltage superimposed with an AC voltage was used as an applied voltage.

The evaluation items were as follows:

(1-1) Image quality after the durability test in an LL environment;

(1-2) Fluctuation in a potential (difference in potential between the light portion in an initial stage and that after 50 sheets were continuously output) in an LL environment;

(1-3) Image quality after the durability test in an HH environment; and (1-4) Contact angle of the surface of the electrophotographic photosensitive member with respect to water after the durability test in an HH environment.

Table 3 shows the evaluation results.

TABLE 3

| Evaluation Item | (1-1) | (1-2) | (1-3) | (1-4) |
|---|---|---|---|---|
| Example 1 | Good | Increased in 22 V | Good | 103° |
| Example 2 | Good | Increased in 25 V | Good | 102° |
| Example 3 | Good | Increased in 30 V | Good | 96° |
| Example 4 | Good | Increased in 35 V | Good | 103° |
| Example 5 | Good | Increased in 25 V | Good | 101° |
| Example 6 | Good | Increased in 27 V | Good | 100° |
| Example 7 | Good | Increased in 21 V | Good | 105° |
| Comparative Example 1 | Fogging, Scratches | Increased in 20 V | Fogging, Scratches | 85° |
| Comparative Example 2 | Light density | Increased in 85 V | Blurring, Scratches | 67° |
| Comparative Example 3 | Scratches | Increased in 25 V | Scratches | 84° |

From the evaluation results shown in Table 3, the following was recognized. In the electrophotographic photosensitive member having a charge transport layer containing the acrylic polymer of the present invention as a surface layer, the image quality after the durability test was stably good, the fluctuation in a potential was not large, and the contact angle of the surface with respect to water was maintained at a high level.

Among them, the fluctuation in a potential was smaller in the case where the charge generating material was a phthalocyanine pigment, than in the case where the charge generating material was an azo pigment. The reason for this is conceivable that: the azo pigment whose charge generation form is of an interface type was influenced more by the acrylic polymer of the present invention contained in the charge transport layer, than the phthalocyanine pigment whose charge generation form is a bulk type.

Among the acrylic polymers, in the case of the electrophotographic photosensitive member having a charge transport layer containing an acrylic polymer having only an alkylene oxide unit without having a polyfluoroolefin unit, the fluctuation in a potential was large, and in addition, the contact angle of the surface with respect to water after the durability test in an HH environment was decreased remarkably, resulting in image blurring.

On the contrary, in the case of the electrophotographic photosensitive member having a charge transport layer containing an acrylic polymer having only a polyfluoroolefin unit without having an alkylene oxide unit, the contact angle of the surface with respect to water, which was high before output of an image, became equal to that of an electrophotographic photosensitive member (Comparative Example 1) with no acrylic polymer added thereto, in an initial stage of the durability test. The reason for this is considered as follows. Due to the absence of an anchor effect by an alkylene oxide unit and an alkylene unit, an acrylic polymer was unevenly distributed on the surface side of the surface layer (charge transport layer).

Example 8

An electrophotographic photosensitive member was produced in the same way as that in Example 1 except that the charge transport layer (surface layer) was formed as follows.

8.5 parts of a charge transport material having a constitution represented by the following formula:

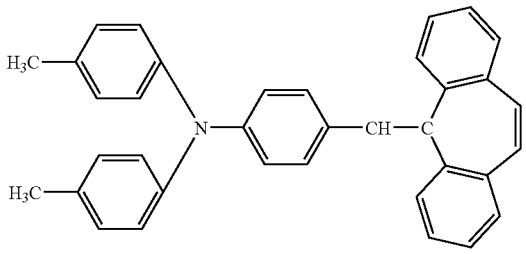

10 parts of a bisphenol Z polycarbonate resin (viscosity-average molecular weight: 40,000, Trade Name: Z-400, produced by Mitsubishi Gas Chemical Co., Inc.) having a repeating unit represented by the following formula:

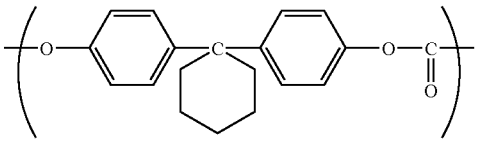

and 1.0 part of the acrylic polymer example (1) were dissolved in 40 parts of monochlorobenzene and 40 parts of tetrahydrofuran. Then, 3.6 parts of polytetrafluoroethylene (PTFE) particles (Trade Name: L-2, produced by Daikin Industries, Ltd.) were added to the above solution, and the mixture was stirred with a homogenizer until the solution became uniform. The PTFE particles were dispersed under a pressure of 58.9 MPa (600 kgf/cm$^2$) using a microfluidizer (produced by Tsukishima Kikai Co., Ltd.). The volume average particle size of the PTFE particles after dispersion was 0.21 μm.

The charge generating layer was coated with the dispersion solution by immersion coating, followed by drying with hot air at 110° C. for one hour to form a charge transport layer with a thickness of 17 μm.

Examples 9–11

Electrophotographic photosensitive members were produced in the same way as that in Example 8 except that the acrylic polymer example (1) in the charge transport layer was changed to acrylic polymer examples (5), (6) and (7), respectively.

The volume average particle sizes of the PTFE particles after dispersion were 0.25 μm, 0.20 μm, and 0.32 μm, respectively.

Example 12

An electrophotographic photosensitive member was produced in the same way as that in Example 8 except that the PTFE particles in the charge transport layer were changed to silicone resin particles (Trade Name: Tospearl 103, produced by Toshiba Silicone Co., Ltd.).

The volume average particle size of the silicone resin particles after dispersion was 0.37 μm.

Comparative Example 4

An electrophotographic photosensitive member was produced in the same way as that in Example 12 except that an acrylic polymer was not added to the charge transport layer.

The volume average particle size of the silicone resin particles after dispersion could not be measured.

Comparative Example 5

An electrophotographic photosensitive member was produced in the same way as that in Example 12 except that the acrylic polymer example (1) in the charge transport layer was changed to an isooctylphyenyl polyethoxyethanol surfactant (Trade Name: TRITON X-102, Rohm and Haas Company (Philadelphia, Pa.))

The volume average particle size of the silicone resin particles after dispersion was 1.55 μm.

Comparative Example 6

Electrophotographic photosensitive members were produced in the same way as that in Example 12 except that the acrylic polymer example (1) in the charge transport layer was changed to acrylic polymer examples (8).

The volume average particle sizes of the silicone resin particles after dispersion were 2.32 μm.

Comparative Example 7

An electrophotographic photosensitive member was produced in the same way as that in Example 8 except that the acrylic polymer example (1) in the charge transport layer was changed to an acrylic polymer (number-average molecular weight: 930, Trade Name: DS-406, produced by Daikin Industries, Ltd.) having a number-average molecular weight of less than 2,000.

The volume average particle size of the PTFE particles after dispersion was 0.89 μm.

According to the present invention, the volume average particle size of the particles was measured by a particle size distribution measurement apparatus produced by Horiba Seisakusho Co., Ltd.

[Evaluation 2]

The electrophotographic photosensitive members produced in Examples 8 to 12 and Comparative Examples 4 to 7 were tested for durable printing of 7,000 sheets of paper in two environments: temperature 5° C./humidity 15 RH % (LL environment) and temperature 32.5° C./humidity 80 RH % (HH environment), in the same way as in Evaluation 1, using Laser Printer LBP-NX produced by Canon Inc. Laser Printer LBP-NX is provided with a contact charging means adopting a charging roller and a cleaning means adopting a cleaning blade made of urethane rubber. Furthermore, in the contact charging means, a DC voltage superimposed with an AC voltage was used as an applied voltage.

The evaluation items were as follows:

(2-1) Image quality after the durability test in an LL environment;

(2-2) Reproducibility of fine lines of an image after the durability test in an LL environment;

(2-3) Fluctuation in a potential (difference in potential between the light portion in an initial stage and that after 50 sheets were continuously output) in an LL environment;

(2-4) Contact angle of the surface of the electrophotographic photosensitive member with respect to water after the durability test in an HH environment; and (2-5) Friction amount of the electrophotographic photosensitive member after 1,000 sheets were output continuously in an HH environment.

The electrophotographic photosensitive member produced in Comparative Example 1 was evaluated for the same items.

Table 4 shows the evaluation results.

TABLE 4

| Evaluation Item | (2-1) | (2-2) | (2-3) | (2-4) | (2-5) |
|---|---|---|---|---|---|
| Example 8 | Good | Good | Increased in 22 V | 112° | 0.65 μm |
| Example 9 | Good | Good | Increased in 25 V | 109° | 0.67 μm |
| Example 10 | Good | Good | Increased in 22 V | 113° | 0.63 μm |
| Example 11 | Good | Good | Increased in 26 V | 107° | 0.68 μm |
| Example 12 | Good | Good | Increased in 28 V | 104° | 0.69 μm |
| Comparative Example 1 | Fogging, Scratches | Good | Increased in 20 V | 85° | 1.32 μm |
| Comparative Example 2 | Circumferential scratches | Line cutting | Increased in 21 V | 92° | 0.87 μm |
| Comparative Example 3 | Circumferential scratches, Decrease in density | Line thinning | Increased in 62 V | 93° | 0.86 μm |
| Comparative Example 4 | Circumferential scratches | Line thinning | Increased in 30 V | 91° | 0.89 μm |
| Comparative Example 5 | Slight Blurring | Line thinning | Increased in 45 V | 95° | 0.85 μm |

From the evaluation results shown in Table 4, the following was recognized. In the electrophotographic photosensitive member containing both the resin particles and the acrylic polymer of the present invention in a charge transport layer (surface layer), the friction amount in a durability test was small, the fluctuation in a potential was not large, the reproducibility of fine lines was good, and the contact angle of the surface with respect to water was maintained at a high level.

In contrast, in the electrophotographic photosensitive members (Comparative Examples 4 to 7) containing resin particles in a charge transport layer (surface layer) without containing the acrylic polymer of the present invention therein, the reproducibility of fine lines was degraded. The reason for this is assumed as follows from the dispersion particle diameter of resin particles in a coating liquid for a charge transport layer. In the electrophotographic photosensitive members of Comparative Examples 4 to 7, resin particles are aggregated in the charge transport layer. Because of this, exposure light scatters to disturb an electrostatic latent image, which may result in degradation of reproducibility of fine lines.

Furthermore, the circumferential scratches on an image after the durability test in Comparative Examples 4 to 6 were caused by those on the surface of the electrophotographic photosensitive members of Comparative Examples 4 to 6, and most of the starting points of the circumferential scratches were minute projections present on the surface of the electrophotographic photosensitive members. These minute projections were analyzed to be aggregations of resin particles.

Example 13

An intermediate layer, a charge generating layer, and a charge transport layer were formed on a support in the same manner as that in Comparative Example 1.

Next, 5.0 parts of a charge transport material having a constitution represented by the following formula:

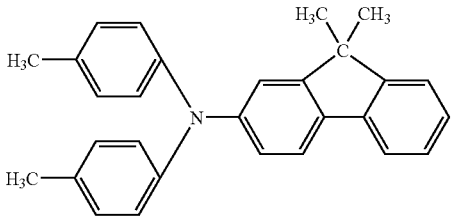

10 parts of a bisphenol Z polycarbonate resin (viscosity-average molecular weight: 80,000, Trade Name: Z-800, produced by Mitsubishi Gas Chemical Co., Inc.) having a repeating unit represented by the following formula:

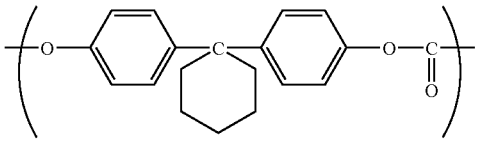

and 3.0 parts of the acrylic polymer example (1) were dissolved in 100 parts of monochlorobenzene and 300 parts of tetrahydrofuran. The above-mentioned charge transport layer was coated with this solution by spray coating, followed by drying with hot air at 120° C. for one hour to form a second charge transport layer with a thickness of 3 μm.

Thus, an electrophotographic photosensitive member comprising the second charge transport layer as a surface layer was produced.

Example 14

An electrophotographic photosensitive member was produced in the same way as that in Example 13 except that the bisphenol Z polycarbonate resin in the second charge transport layer was changed to a polyarylate resin (viscosity-average molecular weight: 12,000) having a repeating unit represented by the following formula:

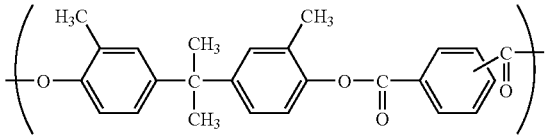

Examples 15

An electrophotographic photosensitive member was produced in the same way as that in Example 13 except that the acrylic polymer example (1) in the second charge transport layer was changed to an acrylic polymer example (7).

Examples 16

An electrophotographic photosensitive member was produced in the same way as that in Example 14 except that the acrylic polymer example (1) in the second charge transport layer was changed to an acrylic polymer example (5).

Example 17

An electrophotographic photosensitive member was produced in the same way as that in Example 13 except that the second charge transport layer (surface layer) was formed as follows.

5.0 parts of a charge transport material having a constitution represented by the following formula:

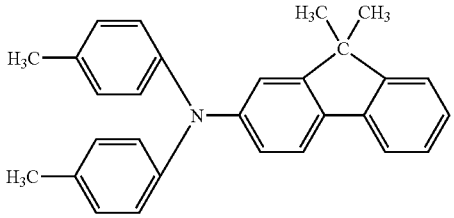

10 parts of a bisphenol Z polycarbonate resin (viscosity-average molecular weight: 80,000, Trade Name: Z-800, produced by Mitsubishi Gas Chemical Co., Inc.) having a repeating unit represented by the following formula:

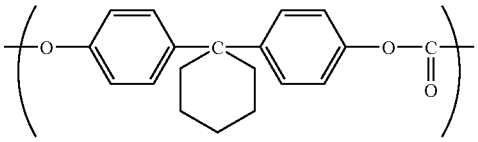

and 3.0 parts of the acrylic polymer example (1) were dissolved in 100 parts of monochlorobenzene and 100 parts of tetrahydrofuran. Then, 3.6 parts of polytetrafluoroethylene (PTFE) particles (Trade Name: L-2, produced by Daikin Industries, Ltd.) were added to the above solution, and the mixture was stirred with a homogenizer until the solution became uniform. The PTFE particles were dispersed under a pressure of 58.9 MPa (600 kgf/cm$^2$) using a microfluidizer (produced by Tsukishima Kikai Co., Ltd.). The volume average particle size of the PTFE particles after dispersion was 0.22 μm.

The above-mentioned charge transport layer was coated with this dispersion solution by spray coating, followed by drying with hot air at 120° C. for one hour to form a second charge transport layer with a thickness of 3 μm.

Example 18

An electrophotographic photosensitive member was produced in the same way as that in Example 17 except that the bisphenol Z polycarbonate resin in the second charge transport layer was changed to a polyarylate resin (viscosity-average molecular weight: 12,000) having a repeating unit represented by the following formula:

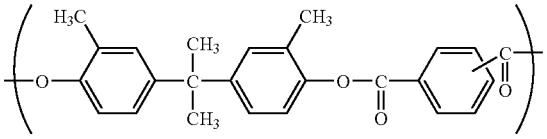

The volume average particle size of the PTFE particles after dispersion was 0.21 μm.

Example 19

An electrophotographic photosensitive member was produced in the same way as that in Example 17 except that the PTFE particles in the second charge transport layer were changed to silicone resin particles (Trade Name: Tospearl 103, produced by Toshiba Silicone Co., Ltd.).

The volume average particle size of the silicone resin particles after dispersion was 0.35 μm.

Example 20

An electrophotographic photosensitive member was produced in the same way as that in Example 18 except that the PTFE particles in the second charge transport layer were changed to silicone resin particles (Trade Name: Tospearl 103, produced by Toshiba Silicone Co., Ltd.).

The volume average particle size of the silicone resin particles after dispersion was 0.36 μm.

Comparative Example 8

An electrophotographic photosensitive member was produced in the same way as that in Example 13 except that the second charge transport layer (surface layer) was formed as follows.

5.0 parts of a charge transport material having a constitution represented by the following formula:

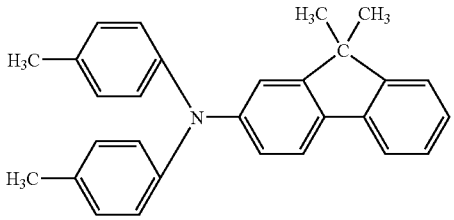

10 parts of a bisphenol A polycarbonate resin (viscosity-average molecular weight: 20,000) having a repeating unit represented by the following formula:

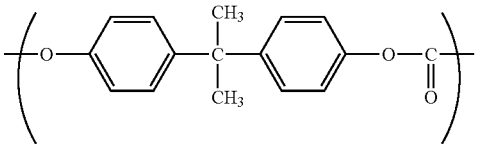

were dissolved in 100 parts of monochlorobenzene and 300 parts of tetrahydrofuran. The above-mentioned charge transport layer was coated with this dispersion solution by spray coating, followed by drying with hot air at 100° C. for one hour to form a second charge transport layer with a thickness of 2 μm.

Comparative Example 9

An electrophotographic photosensitive member was produced in the same way as that in Example 13 except that the second charge transport layer (surface layer) was formed as follows.

5.0 parts of a charge transport material having a constitution represented by the following formula:

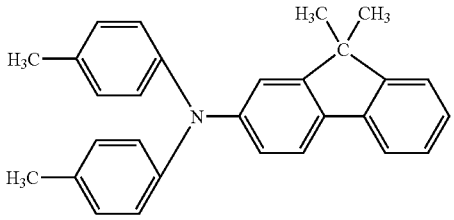

10 parts of a bisphenol A polycarbonate resin (viscosity-average molecular weight: 20,000) having a repeating unit represented by the following formula:

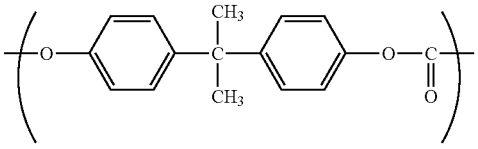

and 2.0 parts of the acrylic polymer example (10) were dissolved in 100 parts of monochlorobenzene and 300 parts of tetrahydrofuran. The above-mentioned charge transport layer was coated with this dispersion solution by immersion coating, followed by drying with hot air at 120° C. for one hour to form a second charge transport layer with a thickness of 2 μm.

Comparative Example 10

An electrophotographic photosensitive member was produced in the same way as that in Example 13 except that the second charge transport layer (surface layer) was formed as follows.

5.0 parts of a charge transport material having a constitution represented by the following formula:

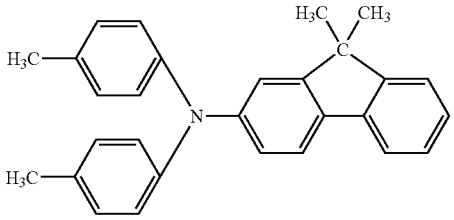

10 parts of a bisphenol Z polycarbonate resin (viscosity-average molecular weight: 2,000, Trade Name: Z-200, produced by Mitsubishi Gas Chemical Co., Inc.) having a repeating unit represented by the following formula:

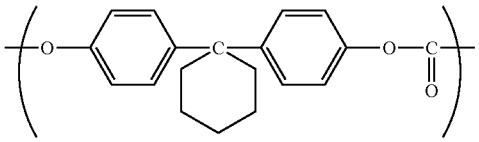

were dissolved in 100 parts of monochlorobenzene and 100 parts of tetrahydrofuran. Then, 3.6 parts of silicone resin particles (Trade Name: Tospearl 103, produced by Toshiba Silicone Co., Ltd.) were added to the above solution, and the mixture was stirred with a homogenizer until the solution became uniform. The silicone resin particles were dispersed under a pressure of 58.9 MPa (600 kgf/cm$^2$) using a microfluidizer (produced by Tsukishima Kikai Co., Ltd.). The volume average particle size of the silicone resin particles after dispersion could not be measured.

The above-mentioned charge transport layer was coated with this dispersion solution by spray coating, followed by drying with hot air at 120° C. for one hour to form a second charge transport layer with a thickness of 4 μm.

[Evaluation 3]

The electrophotographic photosensitive members produced in Examples 13 to 20 and Comparative Examples 8 to 10 were tested for durable printing in two environments: temperature 5° C./humidity 15 RH % (LL environment) and temperature 32.5° C./humidity 80 RH % (HH environment), in the same way as in Evaluation 1, using Laser Printer LBP-NX produced by Canon Inc. Laser Printer LBP-NX is provided with a contact charging means adopting a charging roller and a cleaning means adopting a cleaning blade made of urethane rubber. Furthermore, in the contact charging means, a DC voltage superimposed with an AC voltage was used as an applied voltage. The number of sheets for the durability test was changed from 7,000 to 8,000.

The evaluation items were as follows:

(3-1) Image quality after the durability test in an LL environment;

(3-2) Reproducibility of fine lines of an image after the durability test in an LL environment;

(3-3) Fluctuation in a potential (difference in potential between the light portion in an initial stage and that after 50 sheets were continuously output) in an LL environment;

(3-4) Contact angle of the surface of the electrophotographic photosensitive member with respect to water after the durability test in an HH environment; and (3-5) Friction amount of the electrophotographic photosensitive member after 1,000 sheets were output continuously in an HH environment.

Table 5 shows the evaluation results.

TABLE 5

| Evaluation Item | (3-1) | (3-2) | (3-3) | (3-4) | (3-5) |
|---|---|---|---|---|---|
| Example 13 | Good | Good | Increased in 22 V | 104° | 0.87 μm |
| Example 14 | Good | Good | Increased in 10 V | 97° | 0.77 μm |
| Example 15 | Good | Good | Increased in 11 V | 101° | 0.85 μm |
| Example 16 | Good | Good | Increased in 12 V | 99° | 0.75 μm |
| Example 17 | Good | Good | Increased in 13 V | 113° | 0.41 μm |
| Example 18 | Good | Good | Increased in 12 V | 105° | 0.35 μm |
| Example 19 | Good | Good | Increased in 10 V | 105° | 0.44 μm |
| Example 20 | Good | Good | Increased in 12 V | 102° | 0.32 μm |
| Comparative Example 8 | Scratches | Good | Increased in 10 V | 85° | 1.31 μm |
| Comparative Example 9 | Scratches | Good | Increased in 15 V | 84° | 1.23 μm |
| Comparative Example 10 | Circumferential scratches | Line thinning | Increased in 12 V | 91° | 0.98 μm |

From the evaluation results shown in Table 5, the following was recognized. In the electrophotographic photosensitive member having a second charge transport layer (surface layer) containing the acrylic polymer of the present invention, the image quality after the durability test was stably good, the fluctuation in a potential was considerably small, and the contact angle of the surface with respect to water was maintained at a high level.

In the case of the electrophotographic photosensitive member having a second charge transport layer containing an acrylic polymer having only a polyfluoroolefin unit without having an alkylene oxide unit, the contact angle of the surface with respect to water, which was high before output of an image, became equal to that of an electrophotographic photosensitive member (Comparative Example 8) with no acrylic polymer added thereto, in an initial stage. The reason for this is conceivable as follows. Due to the absence of an anchor effect by an alkylene oxide unit and an alkylene unit, an acrylic polymer was unevenly distributed on the surface side of the surface layer (second charge transport layer).

Further, in the electrophotographic photosensitive member containing both the resin particles and the acrylic polymer of the present invention in a second charge transport layer (surface layer), the friction amount in a durability test was small, the fluctuation in a potential was not large, the reproducibility of fine lines was good, and the contact angle of the surface with respect to water was maintained at a high level.

It is understood that the fluctuation in a potential is smaller in the electrophotographic photosensitive members of Examples 13 to 20 than in the electrophotographic photosensitive members of Examples 1 to 12. The reason for this is conceivable that: the surface layer (second charge transport layer) of the electrophotographic photosensitive member containing the acrylic polymer of the present invention is not in contact with the charge generating layer, so that injection of charge from the charge generating layer to the charge transport layer (from the charge generating material to the charge transport material) cannot be prevented.

In the electrophotographic photosensitive members (Comparative Example 10) containing resin particles in a second charge transport layer (surface layer) without containing the acrylic polymer of the present invention therein, the reproducibility of fine lines was degraded. The reason for this is assumed as follows from the dispersion particle diameter of resin particles in a coating liquid for a second charge transport layer. In the electrophotographic photosensitive members of Comparative Example 10, resin particles are aggregated in the second charge transport layer. Because of this, exposure light scatters to disturb an electrostatic latent image, which may result in degradation of reproducibility of fine lines.

Furthermore, the circumferential scratches on an image after the durability test in Comparative Example 10 were caused by those on the surface of the electrophotographic photosensitive member of Comparative Example 10, and most of the starting points of the circumferential scratches were minute projections present on the surface of the electrophotographic photosensitive member. These minute projections were analyzed to be aggregations of resin particles.

Example 21

An intermediate layer, a charge generating layer, and a charge transport layer were formed on a support in the same way as in Comparative Example 1.

Then, 50 parts of antimony-doped conductive tin oxide particles (Trade Name: T-1, produced by Mitsubishi Materials Corporation, average particle size: 0.03 μm), which was surface-treated (treatment amount 6.5%) with a siloxane compound having a repeating unit represented by the following formula, were added to 150 parts of acetone.

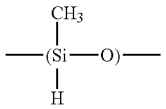

The mixture was dispersed by a sand mill for 72 hours. Then, 1.5 parts of the acrylic polymer example (1) and 15 parts of a resole type phenol resin (Trade Name: PL-4852, produced by Gun-ei Chemical Industry Co., Ltd.) were dissolved in the dispersion solution. The charge transport layer was coated with this solution by spray coating. The solution was cured by heating at 155° C. for one hour to form a protective layer (cured resin layer) having a thickness of 3 μm.

Thus, an electrophotographic photosensitive member including a protective layer (cured resin layer) as a surface layer was produced.

Example 22

An electrophotographic photosensitive member was produced in the same way as that in Example 21 except that the phenol resin in the protective layer (cured resin layer) was changed to amino resin (Trade Name: Cymel C-370, produced by Mitsui Cytec Ltd.), and the acrylic polymer example (1) was changed to an acrylic polymer example (2).

Example 23

An electrophotographic photosensitive member was produced in the same way as that in Example 23 except that the protective layer (cured resin layer) that was a surface layer was formed as follows.

7 parts of a charge transport material having a constitution represented by the above-mentioned formula (C-9), 12 parts of a resole type phenol resin (Trade Name: PL-4852, produced by Gun-ei Chemical Industry Co., Ltd.), and 1.3 parts of the acrylic polymer example (1) were dissolved in 73 parts of ethanol. The charge transport layer was coated with this solution by immersion coating. Then, the solution was cured by heating at 155° C. for one hour to form a protective layer (cured resin layer) having a thickness of 3 μm. The protective layer (cured resin layer) is also a second charge transport layer.

Example 24

An electrophotographic photosensitive member was produced in the same way as that in Example 23 except that the protective layer (cured resin layer) that was a surface layer was formed as follows.

9 parts of a charge transport material having a constitution represented by the above-mentioned formula (C-14), 8 parts of partial polycondensate of tetramethoxysilane (Trade Name: Metyl-silicate-51, produced by Colcoat Co., Ltd.), and 1.3 parts of the acrylic polymer example (4) were dissolved in 73 parts of tetrahydrofuran. The charge transport layer was coated with this solution by spray coating. Then, the solution was cured by heating at 155° C. for one hour to form a protective layer (cured resin layer) having a thickness of 3 μm. The protective layer (cured resin layer) is also a second charge transport layer.

Example 25

An electrophotographic photosensitive member was produced in the same way as that in Example 23 except that the protective layer (cured resin layer) that was a surface layer was formed as follows.

9 parts of a charge transport material having a constitution represented by the above-mentioned formula (C-31), 8 parts of an isocyanate resin (Trade Name: Sumidur N-3500, produced by Sumitomo Bayer Urethane Co., Ltd.), and 1.3 parts of the acrylic polymer example (5) were dissolved in 63 parts of acetone. The charge transport layer was coated with this solution by spray coating. Then, the solution was cured by heating at 155° C. for one hour to form a protective layer (cured resin layer) having a thickness of 3 μm. The protective layer (cured resin layer) is also a second charge transport layer.

Example 26

An electrophotographic photosensitive member was produced in the same way as that in Example 23 except that the protective layer (cured resin layer) that was a surface layer was formed as follows.

9 parts of a charge transport material having a constitution represented by the above-mentioned formula (C-9), 8 parts of an amino resin (Trade Name: Cymel S-720, produced by Mitsui Cytec Ltd.), and 1.3 parts of the acrylic polymer example (3) were dissolved in 73 parts of ethyl acetate. The charge transport layer was coated with this solution by spray coating. Then, the solution was cured by heating at 155° C. for one hour to form a protective layer (cured resin layer) having a thickness of 3 μm. The protective layer (cured resin layer) is also a second charge transport layer.

Examples 27–32

Electrophotographic photosensitive members were produced in the same way as that in Example 23 except that the charge transport material in the protective layer (cured resin layer) was changed to charge transport materials having constitutions represented by the above-mentioned formulas (C-34), (C-51), (C-38), (C-56), (C-61), and (C-62), respectively.

Comparative Example 11

An electrophotographic photosensitive member was produced in the same way as that in Example 22 except that an acrylic polymer was not added to the protective layer (cured resin layer), and acetone that was a solvent was changed to ethanol.

Comparative Example 12

An electrophotographic photosensitive member was produced in the same way as that in Example 23 except that the protective layer (cured resin layer) that was a surface layer was formed as follows.

9 parts of a charge transport material having a constitution represented by the above-mentioned formula (C-51) and 8 parts of an amino resin (Trade Name: Cymel S-370, produced by Mitsui Cytec Ltd.) were dissolved in 73 parts of acetone. The charge transport layer was coated with this solution by spray coating. Then, the solution was cured by heating at 155° C. for one hour to form a protective layer (cured resin layer) having a thickness of 3 μm. The protective layer (cured resin layer) is also a second charge transport layer.

Comparative Example 13

An electrophotographic photosensitive member was produced in the same way as that in Comparative Example 12 except that 9 parts of the acrylic polymer example (9) were added to the coating liquid for a protective layer (cured resin layer).

Comparative Example 14

An electrophotographic photosensitive member was produced in the same way as that in Comparative Example 13 except that the acrylic polymer example (9) in the protective layer (cured resin layer) was changed to an acrylic polymer example (10).

[Evaluation 4]

The surface state was observed in the electrophotographic photosensitive members produced in Examples 21 to 32 and Comparative Examples 11 to 14. Those electrophotographic photosensitive members were tested for durable printing of 7,000 sheets of paper in two environments: temperature 5° C./humidity 15 RH % (LL environment) and temperature 32.5° C./humidity 80 RH % (HH environment), in the same way as in Evaluation 1, using Laser Printer LBP-NX produced by Canon Inc. Laser Printer LBP-NX is provided with a contact charging means adopting a charging roller and a cleaning means adopting a cleaning blade made of urethane rubber. Furthermore, in the contact charging means, a DC voltage superimposed with an AC voltage was used as an applied voltage.

The evaluation items were as follows:

(4-1) Observation results of surface state;

(4-2) Image quality after the durability test in an LL environment;

(4-3) Fluctuation in a potential (difference in potential between the light portion in an initial stage and that after 50 sheets were continuously output) in an LL environment;

(4-4) Image quality after the durability test in an HH environment; and (4-5) Contact angle of the surface of the electrophotographic photosensitive member with respect to water after the durability test in an HH environment.

Table 6 shows the evaluation results.

TABLE 6

| Evaluation Item | (4-1) | (4-2) | (4-3) | (4-4) | (4-5) |
|---|---|---|---|---|---|
| Example 21 | Even | Good | Increased in 28 V | Good | 95° |
| Example 22 | Even | Good | Increased in 30 V | Good | 92° |
| Example 23 | Even | Good | Increased in 24 V | Good | 96° |
| Example 24 | Even | Good | Increased in 23 V | Good | 96° |
| Example 25 | Even | Good | Increased in 26 V | Good | 97° |
| Example 26 | Slight cloudiness | Good | Increased in 30 V | Good | 93° |
| Example 27 | Even | Good | Increased in 22 V | Good | 94° |
| Example 28 | Slight cloudiness | Good | Increased in 32 V | Good | 99° |
| Example 29 | Even | Good | Increased in 24 V | Good | 92° |
| Example 30 | Even | Good | Increased in 23 V | Good | 94° |
| Example 31 | Even | Good | Increased in 26 V | Good | 98° |
| Example 32 | Even | Good | Increased in 21 V | Good | 91° |
| Comparative Example 11 | Even | Good | Increased in 26 V | Blurring | 73° |

TABLE 6-continued

| Evaluation Item | (4-1) | (4-2) | (4-3) | (4-4) | (4-5) |
|---|---|---|---|---|---|
| Comparative Example 12 | Crawling | Good | Increased in 26 V | Slight Blurring | 74° |
| Comparative Example 13 | Slight crawling | Good | Increased in 49 V | Deletion | 60° |
| Comparative Example 14 | Even | Good | Increased in 24 V | Slight Blurring | 73° |

From the evaluation results shown in Table 6, the following was recognized. In the electrophotographic photosensitive member having as a surface layer a protective layer (cured resin layer) containing the acrylic polymer of the present invention, the image quality after the durability test was stably good, the fluctuation in a potential was considerably small, and the contact angle of the surface with respect to water was maintained at a high level.

In the case of the electrophotographic photosensitive member (Comparative Example 14) having a protective layer (cured resin layer) containing an acrylic polymer having only a polyfluoroolefin unit without having an alkylene oxide unit, the contact angle of the surface with respect to water, which was high before output of an image, became equal to that of an electrophotographic photosensitive member (Comparative Example 12) with no acrylic polymer added thereto, in an initial stage. The reason for this is conceivable as follows. Due to the absence of an anchor effect by an alkylene oxide unit and an alkylene unit, an acrylic polymer was unevenly distributed on the surface side of the surface layer (protective layer (cured resin layer)).

Among the acrylic polymers, in the case of the electrophotographic photosensitive member (Comparative Example 13) having a surface layer (protective layer (cured resin layer)) containing an acrylic polymer having only an alkylene oxide unit without having a polyfluoroolefin unit, the fluctuation in a potential was large, and in addition, the contact angle of the surface with respect to water in an HH environment was decreased remarkably, resulting in image deletion.

The surfaces of the electrophotographic photosensitive members of Examples 26 and 28 exhibited slight cloudiness, although it was not a practically serious problem. This is considered to be caused by the following reason: δa of the solvent used for forming a protective layer (cured resin layer) that is a surface layer is smaller than 2.5 (in both ethyl acetate and diethyl ether, δa=2.0), so that the solubility of the acrylic polymer of the present invention is not so high.

Although slight crawling of a coating liquid for a protective layer (cured resin layer) was observed on the surfaces of the electrophotographic photosensitive members of Comparative Examples 12 and 13, no crawling was observed on the surface of the electrophotographic photosensitive member in which a protective layer (cured resin layer) was formed using a coating liquid containing the acrylic polymer of the present invention. It was also found that a leveling function was obtained when a layer with a high polarity was provided on the surface of a resin with a relatively low polarity such as a charge transport layer, by adding the acrylic polymer of the present invention thereto.

Compared with the scratches formed on the surfaces of the electrophotographic photosensitive members of Examples 1 to 7 and Comparative Examples 11 to 14 after the durability test, the scratches formed on the surfaces of the electrophotographic photosensitive members of Examples 21 to 32 after the durability test were very slight. Thus, it was found that the durability of the electrophotographic photosensitive member was enhanced further by including the acrylic polymer of the present invention in a protective layer (cured resin layer).

Example 33

An intermediate layer, a charge generating layer, and a charge transport layer were formed on a support in the same way as in Comparative Example 1.

Then, 50 parts of antimony-doped conductive tin oxide particles (Trade Name: T-1, produced by Mitsubishi Materials Corporation, average particle size: 0.03 μm) surface-treated (treatment amount 6.5%) with a siloxane compound having a repeating unit represented by the following formula were added to: 150 parts of ethanol.

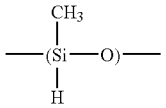

The mixture was dispersed by a sand mill for 72 hours. Then, 0.85 parts of the acrylic polymer example (4) and 15 parts of polytetrafluoroethylene (PTFE) particles (Trade Name: L-2, produced by Daikin Industries, Ltd.) were added to the above dispersion solution, and the mixture was stirred with a homogenizer until the solution became uniform. The PTFE particles were dispersed under a pressure of 58.9 MPa (600 kgf/cm$^2$) using a microfluidizer (produced by Tsukishima Kikai Co., Ltd.). The volume average particle size of the PTFE particles after dispersion was 0.19 μm.

Then, 30 parts of a resole type phenol resin (Trade Name: XPL-8264E, produced by Gun-ei Chemical Industry Co., Ltd.) were dissolved in the dispersion solution. The charge transport layer was coated with this solution by spray coating. The solution was cured by heating at 155° C. for one hour to form a protective layer (cured resin layer) having a thickness of 3 μm.

Thus, an electrophotographic photosensitive member including a protective layer (cured resin layer) as a surface layer was produced.

Example 34

An electrophotographic photosensitive member was produced in the same way as that in Example 33 except that the phenol resin in the protective layer (cured resin layer) was changed to an amino resin (Trade Name: Cymel C-701, produced by Mitsui Cytec Ltd.).

The volume average particle size of the PTFE particles after dispersion was 0.21 μm.

Example 35

An electrophotographic photosensitive member was produced in the same way as that in Example 33 except that the protective layer (cured resin layer) that was a surface layer was formed as follows.

0.75 parts of the acrylic polymer example (2) and 10 parts of particles of polytetrafluoroethylene (PTFE) (Trade Name: L-2, produced by Daikin Industries, Ltd.) were added to 100 parts of ethanol. The mixture was stirred with a homogenizer until the solution became uniform. The PTFE particles were dispersed under a pressure of 58.9 MPa (600 kgf/cm$^2$) using a microfluidizer (produced by Tsukishima Kikai Co., Ltd.). The volume average particle size of the PTFE particles after dispersion was 0.22 μm.

Then, 22 parts of a charge transport material having a constitution represented by the above formula (C-9) and 28 parts of a phenol resin (Trade Name: PL-4852, produced by Gun-ei Chemical Industry Co., Ltd.) were dissolved in the dispersion solution. The charge transport layer was coated with the resultant solution. The solution was cured by heating at 155° C. for one hour to form a protective layer (cured resin layer) having a thickness of 3 μm. This protective layer (cured resin layer) is also a second charge transport layer.

Example 36

An electrophotographic photosensitive member was produced in the same way as that in Example 35 except that the acrylic polymer example (2) in the protective layer (cured resin layer) was changed to the acrylic polymer example (3), the charge transport material having a constitution represented by the above formula (C-9) was changed to a charge transport material having a constitution represented by the above formula (C-4), the phenol resin was changed to amino resin (Trade Name: Cymel C-701, produced by Mitsui Cytec Ltd.), and the PTFE particles were changed to silicone resin particles (Trade Name: Tospearl 103, produced by Toshiba Silicone Co., Ltd.).

The volume average particle size of the silicone resin particles after dispersion was 0.35 μm.

Example 37

An electrophotographic photosensitive member was produced in the same way as that in Example 35 except that the acrylic polymer example (2) in the protective layer (cured resin layer) was changed to the acrylic polymer example (5), the charge transport material having a constitution represented by the above formula (C-9) was changed to a charge transport material having a constitution represented by the above formula (C-31), and the phenol resin was changed to an isocyanate resin (Trade Name: Sumidur N-3500, produced by Sumitomo Bayer Urethane Co., Ltd.).

The volume average particle size of the PTFE particles after dispersion was 0.24 μm.

Example 38

An electrophotographic photosensitive member was produced in the same way as that in Example 35 except that the acrylic polymer example (2) in the protective layer (cured resin layer) was changed to the acrylic polymer example (6), the charge transport material having a constitution represented by the above formula (C-9) was changed to a charge transport material having a constitution represented by the above formula (C-14), and the phenol resin was changed to partial polycondensate of tetramethoxysilane (Trade Name: Metyl-silicate-51, produced by Colcoat Co., Ltd.).

The volume average particle size of the PTFE particles after dispersion was 0.25 μm.

Example 39

An electrophotographic photosensitive member was produced in the same way as that in Example 35 except that the acrylic polymer example (2) in the protective layer (cured resin layer) was changed to the acrylic polymer example (1), the charge transport material having a constitution represented by the above formula (C-9) was changed to a charge transport material having a constitution represented by the above formula (C-36), and the PTFE particles were changed to silicone resin particles (Trade Name: Tospearl 103, produced by Toshiba Silicone Co., Ltd.).

The volume average particle size of the silicone resin particles after dispersion was 0.37 μm.

Example 40

An electrophotographic photosensitive member was produced in the same way as that in Example 35 except that the acrylic polymer example (2) in the protective layer (cured resin layer) was changed to the acrylic polymer example (3), and the charge transport material having a constitution represented by the above formula (C-56) was changed to a charge transport material having a constitution represented by the above formula (C-56).

The volume average particle size of the PTFE particles after dispersion was 0.24 μm.

Example 41

An electrophotographic photosensitive member was produced in the same way as that in Example 35 except that the acrylic polymer example (2) in the protective layer (cured resin layer) was changed to the acrylic polymer example (3), and the charge transport material having a constitution represented by the above formula (C-9) was changed to a charge transport material having a constitution represented by the above formula (C-56).

The volume average particle size of the PTFE particles after dispersion was 0.27 μm.

Example 42

An electrophotographic photosensitive member was produced in the same way as that in Example 35 except that the acrylic polymer example (2) in the protective layer (cured resin layer) was changed to the acrylic polymer example (1), and the charge transport material having a constitution represented by the above formula (C-9) was changed to a charge transport material having a constitution represented by the above formula (C-61).

The volume average particle size of the PTFE particles after dispersion was 0.24 μm.

Example 43

An electrophotographic photosensitive member was produced in the same way as that in Example 35 except that the acrylic polymer example (2) in the protective layer (cured resin layer) was changed to the acrylic polymer example (1), and the charge transport material having a constitution represented by the above formula (C-9) was changed to a charge transport material having a constitution represented by the above formula (C-62).

The volume average particle size of the PTFE particles after dispersion was 0.21 μm.

Example 44

An electrophotographic photosensitive member was produced in the same way as that in Example 35 except that the acrylic polymer example (2) in the protective layer (cured resin layer) was changed to the acrylic polymer example (1), and the charge transport material having a constitution represented by the above formula (C-9) was changed to a charge transport material having a constitution represented by the above formula (C-63).

The volume average particle size of the PTFE particles after dispersion was 0.22 μm.

Example 45

An electrophotographic photosensitive member was produced in the same way as that in Example 33 except that the protective layer (cured resin layer) that was a surface layer was formed as follows.

0.75 parts of the acrylic polymer example (1) and 10 parts of particles of polytetrafluoroethylene (PTFE) (Trade Name: L-2, produced by Daikin Industries, Ltd.) were added to 100 parts of methanol. The mixture was stirred with a homogenizer until the solution became uniform. The PTFE particles were dispersed under a pressure of 58.9 MPa (600 $kgf/cm^2$) using a microfluidizer (produced by Tsukishima Kikai Co., Ltd.). The volume average particle size of the PTFE particles after dispersion was 0.23 μm.

Then, 40 parts of a charge transport material having a constitution represented by the above formula (C-61) was dissolved in the dispersion solution. The charge transport layer was coated with the resultant solution. The solution was cured by heating at 155° C. for one hour to form a protective layer (cured resin layer) having a thickness of 2 μm. This protective layer (cured resin layer) is also a second charge transport layer.

Example 46

An electrophotographic photosensitive member was produced in the same way as that in Example 45 except that the charge transport material having a constitution represented by the above formula (C-61) in the protective layer (cured resin layer) was changed to a charge transport material having a constitution represented by the above formula (C-62).

The volume average particle size of the PTFE particles after dispersion was 0.26 μm.

Example 47

An electrophotographic photosensitive member was produced in the same way as that in Example 45 except that the charge transport material having a constitution represented by the above formula (C-61) in the protective layer (cured resin layer) was changed to a charge transport material having a constitution represented by the above formula (C-63).

The volume average particle size of the PTFE particles after dispersion was 0.27 μm.

Comparative Example 15

An electrophotographic photosensitive member was produced in the same way as that in Example 34 except that an acrylic polymer was not added to the protective layer (cured resin layer).

The volume average particle size of the PTFE particles after dispersion was 2.11 μm.

Comparative Example 16

An electrophotographic photosensitive member was produced in the same way as that in Example 36 except that an acrylic polymer was not added to the protective layer (cured resin layer).

The volume average particle size of the PTFE particles after dispersion was 1.87 μm.

Comparative Example 17

An electrophotographic photosensitive member was produced in the same way as that in Example 36 except that the acrylic polymer example (3) in the protective layer (cured resin layer) was changed to the acrylic polymer example (9).

The volume average particle size of the silicone resin particles after dispersion was 1.02 μm.

Comparative Example 18

An electrophotographic photosensitive member was produced in the same way as that in Example 36 except that the acrylic polymer example (3) in the protective layer (cured resin layer) was changed to the acrylic polymer example (11).

The volume average particle size of the silicone resin particles after dispersion was 0.96 μm.

[Evaluation 5]

The electrophotographic photosensitive members produced in Examples 33 to 47 and Comparative Examples 15 to 18 were tested for durable printing in two environments: temperature 5° C./humidity 15 RH % (LL environment) and temperature 32.5° C./humidity 80 RH % (HH environment), in the same way as in Evaluation 1, using Laser Printer LBP-NX produced by Canon Inc. Laser Printer LBP-NX is provided with a contact charging means adopting a charging roller and a cleaning means adopting a cleaning blade made of urethane rubber. Furthermore, in the contact charging means, a DC voltage superimposed with an AC voltage was used as an applied voltage. The number of sheets for the durability test was changed from 7,000 to 10,000.

The evaluation items were as follows:

(5-1) Image quality after the durability test in an LL environment;

(5-2) Reproducibility of fine lines of an image after the durability test in an LL environment;

(5-3) Fluctuation in a potential (difference in potential between the light portion in an initial stage and that after 50 sheets were continuously output) in an LL environment;

(5-4) Contact angle of the surface of the electrophotographic photosensitive member with respect to water after the durability test in an HH environment; and (5-5) Friction amount of the electrophotographic photosensitive member after 1,000 sheets were output continuously in an HH environment.

Table 7 shows the evaluation results.

TABLE 7

| Evaluation Item | (5-1) | (5-2) | (5-3) | (5-4) | (5-5) |
|---|---|---|---|---|---|
| Example 33 | Good | Good | Increased in 35 V | 108° | 0.32 μm |
| Example 34 | Good | Good | Increased in 36 V | 104° | 0.33 μm |
| Example 35 | Good | Good | Increased in 23 V | 107° | 0.35 μm |
| Example 36 | Good | Good | Increased in 24 V | 110° | 0.36 μm |
| Example 37 | Good | Good | Increased in 26 V | 106° | 0.35 μm |
| Example 38 | Good | Good | Increased in 26 V | 105° | 0.42 μm |
| Example 39 | Good | Good | Increased in 26 V | 102° | 0.31 μm |
| Example 40 | Good | Good | Increased in 22 V | 105° | 0.35 μm |
| Example 41 | Good | Good | Increased in 21 V | 106° | 0.45 μm |
| Example 42 | Good | Good | Increased in 23 V | 102° | 0.34 μm |
| Example 43 | Good | Good | Increased in 24 V | 101° | 0.41 μm |
| Example 44 | Good | Good | Increased in 26 V | 104° | 0.33 μm |
| Example 45 | Good | Good | Increased in 12 V | 109° | 0.37 μm |
| Example 46 | Good | Good | Increased in 11 V | 102° | 0.36 μm |
| Example 47 | Good | Good | Increased in 13 V | 101° | 0.35 μm |
| Comparative Example 15 | Circumferential scratches | Line cutting | Increased in 37 V | 82° | 0.77 μm |
| Comparative Example 16 | Circumferential scratches | Line thinning | Increased in 29 V | 88° | 0.67 μm |
| Comparative Example 17 | Circumferential scratches and Blurring | Line thinning | Increased in 55 V | 64° | 0.98 μm |
| Comparative Example 18 | Slight circumferential scratches | Line thinning | Increased in 45 V | 86° | 0.66 μm |

From the evaluation results shown in Table 7, the following was recognized. In the electrophotographic photosensitive member containing both the curable resin and the acrylic polymer of the present invention in the protective layer (surface layer), a friction amount in the durability test was very small, and the reproducibility of fine lines was good. Furthermore, even in a durability test in an HH environment, irrespective of a very small friction amount, the contact angle of the surface with respect to water was maintained at a high level. The electrophotographic photosensitive member containing a charge transport material in a surface layer had less fluctuation in a potential. In particular, when the charge transport material is three-dimensionally cross-linked in the surface layer (Examples 45 to 47), very stable characteristics are exhibited.

In contrast, the electrophotographic photosensitive members (Comparative Examples 15 and 16) containing resin particles in the charge transport layer (surface layer) without containing the acrylic polymer of the present invention, resulted in degraded reproducibility of fine lines. This is assumed as follows from the dispersion particle diameter of resin particles in the charge transport layer coating liquid. In the electrophotographic photosensitive members of Comparative Examples 15 and 16, resin particles were aggregated considerably in the charge transport layer. Because of this, exposure light scatters to disturb an electrostatic latent image, resulting in degraded reproducibility of fine lines.

Furthermore, the circumferential scratches on an image after the durability test in Comparative Examples 15 to 17 were caused by those on the surfaces of the electrophotographic photosensitive members of Comparative Examples 15 to 17. Most of the starting points of the circumferential scratches were minute projections present on the surfaces of the electrophotographic photosensitive members. These minute projections were analyzed to be aggregations of resin particles. Furthermore, slight circumferential scratches were observed on an image after the durability test in Comparative Example 18. This is assumed as follows. The molecular weight of the acrylic polymer used in Comparative Example 18 was too large. Therefore the solubility thereof with respect to a solvent was not sufficient, which reduced the function of dispersing resin particles (silicone resin particles) uniformly.

According to the present invention, an electrophotographic photosensitive member having excellent lubricity, enhanced abrasion resistance, excellent electrophotographic characteristics, and long life can be provided, in which an image is not degraded. Furthermore, a process cartridge and an electrophotographic apparatus having such an electrophotographic photosensitive member can be provided.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. An electrophotographic photosensitive member comprising a photosensitive layer on a support, wherein a surface layer of the electrophotographic photosensitive member comprises an acrylic polymer having (a) a polyfluoroolefin unit and an alkylene oxide unit, (b) a number-average molecular weight in a range of 2,000 to 20,000, and (c) a molar ratio of the polyfluoroolefin unit to the alkylene oxide unit of 0.1:1 to 2:1.

2. The electrophotographic photosensitive member according to claim 1, wherein the acrylic polymer is a copolymer obtained through the polymerization of an acrylic ester monomer having the polyfluoroolefin unit with the acrylic ester monomer having the alkylene oxide unit.

3. The electrophotographic photosensitive member according to claim 1, wherein the acrylic polymer is a polymer obtained through the polymerization of an acrylic ester monomer having the polyfluoroolefin unit and the alkylene oxide unit.

4. The electrophotographic photosensitive member according to claim 2, wherein the acrylic polymer is obtained through the polymerization of the acrylic ester monomers with an acrylic alkyl ester having 2 to 12 carbon atoms.

5. The electrophotographic photosensitive member according to claim 1, wherein the acrylic polymer is obtained through the polymerization of the acrylic ester monomer with an acrylic alkyl ester having 2 to 12 carbon atoms.

6. The electrophotographic photosensitive member accordingly to claim 1, wherein the polyfluoroolefin unit is a polyfluoroalkylene unit.

7. The electrophotographic photosensitive member according to claim 1, wherein the alkylene oxide unit is an ethylene oxide unit.

8. The electrophotographic photosensitive member according to claim 1, wherein the polyfluoroolefin unit has 7 to 29 fluorine atoms per unit.

9. The electrophotographic photosensitive member according to claim 1, wherein the surface layer of the electrophotographic photosensitive member comprises at least one of resin particles containing fluorine atoms and resin particles containing silicon atoms.

10. An electrophotographic photosensitive member according to claim 1, wherein the surface layer of the electrophotographic photosensitive member comprises a curable resin as a binder resin.

11. An electrophotographic photosensitive member according to claim 1, wherein the surface layer of the electrophotographic photosensitive member comprises a charge transport material.

12. An electrophotographic photosensitive member according to claim 11, wherein the surface layer of the electrophotographic photosensitive member is formed from a coating liquid for a surface layer containing a charge transport material having a hydroxy group.

13. An electrophotographic photosensitive member according to claim 11, wherein the charge transport material in the surface layer of the electrophotographic photosensitive member is three-dimensionally cross-linked.

14. An electrophotographic photosensitive member according to claim 1, wherein the surface layer of the electrophotographic photosensitive member is formed from a coating liquid for a surface layer containing organic solvent at a boiling point of 50° C. to 120° C. having a proton acceptor parameter of 2 or more.

15. An electrophotographic photosensitive member according to claim 1, wherein the photosensitive layer is a stacked photosensitive layer in which a charge generating layer and a charge transport layer are stacked in this order from the support side.

16. An electrophotographic photosensitive member according to claim 15, wherein the surface layer of the electrophotographic photosensitive member is not in contact with the charge generating layer.

17. An electrophotographic photosensitive member according to claim 1, wherein a content of the charge generating material of the surface layer of the electrophotographic photosensitive member is 0 to 5,000 ppm by mass with respect to a total mass of the surface layer.

18. A process cartridge that integrally supports an electrophotographic photosensitive member comprising a photosensitive layer on a support and at least one unit selected from the group consisting of a charging unit, a developing unit, a transfer unit, and a cleaning unit and that is detachably attached to an electrophotographic apparatus, wherein a surface layer of the electrophotographic photosensitive member comprises an acrylic polymer having (a) a polyfluoroolefin unit and an alkylene oxide unit, (b) a number-average molecular weight in a range of 2,000 to 20,000, and (c) a molar ratio of the polyfluoroolefin unit to the alkylene oxide unit of 0.1:1 to 2:1.

19. An electrophotographic apparatus having: an electrophotographic photosensitive member having a photosensitive layer on a support; a charging unit; an exposing unit; a developing unit; and a transfer unit;

wherein a surface layer of the electrophotographic photosensitive member comprises an acrylic polymer having (a) a polyfluoroolefin unit and an alkylene oxide unit, (b) a number-average molecular weight in a range of 2,000 to 20,000, and (c) a molar ratio of the polyfluoroolefin unit to the alkylene oxide unit of 0.1:1 to 2:1.

* * * * *